US011865672B1

(12) United States Patent
Mortensen et al.

(10) Patent No.: US 11,865,672 B1
(45) Date of Patent: Jan. 9, 2024

(54) POLYCRYSTALLINE DIAMOND COMPACTS, METHODS OF FABRICATING THE SAME, AND METHODS OF USING THE SAME

(71) Applicant: US SYNTHETIC CORPORATION, Orem, UT (US)

(72) Inventors: Daniel Call Mortensen, Eagle Mountain, UT (US); Lindsay Sue Patton, Provo, UT (US); Trevor Allen Olsen, Spanish Fork, UT (US); Casey Wade Swan, Spanish Fork, UT (US); Shawn Casey Scott, Payson, UT (US); Matthew Kimball Baker, Provo, UT (US); Anne-Grethe Slotnaes, South Jordan, UT (US); Kenneth E. Bertagnolli, Riverton, UT (US); Jiang Qian, Cedar Hills, UT (US); Jason Lott, Payson, UT (US); Joshua Adam Hawks, Saratoga Springs, UT (US)

(73) Assignee: US Synthetic Corporation, Orem, UT (US)

( * ) Notice: Subject to any disclaimer, the term of this patent is extended or adjusted under 35 U.S.C. 154(b) by 115 days.

(21) Appl. No.: 16/518,049

(22) Filed: Jul. 22, 2019

Related U.S. Application Data

(62) Division of application No. 15/402,525, filed on Jan. 10, 2017, now Pat. No. 10,399,206.
(Continued)

(51) Int. Cl.
*C22C 1/04* (2023.01)
*B24D 3/00* (2006.01)
(Continued)

(52) U.S. Cl.
CPC ..... *B24D 3/007* (2013.01); *B24D 3/10* (2013.01); *C22C 1/04* (2013.01); *C22C 1/05* (2013.01);
(Continued)

(58) Field of Classification Search
CPC ..... B24D 3/007
See application file for complete search history.

(56) References Cited

U.S. PATENT DOCUMENTS 3,090,614 A 5/1963 Freeman et al.
3,655,233 A 4/1972 Twist
(Continued)

FOREIGN PATENT DOCUMENTS

WO WO 2016/044136 3/2016

OTHER PUBLICATIONS

U.S. Appl. No. 12/830,878, filed Jul. 6, 2010, Wiggins et al.
(Continued)

*Primary Examiner* — Christopher S Kessler
(74) *Attorney, Agent, or Firm* — PCFB LLC

(57) ABSTRACT

PDCs, methods of fabricating the PDCs, and methods of using the PDCs are disclosed herein. The PDCs include a PCD table bonded to a substrate. The PCD table includes an upper surface having a plurality of recessed features formed therein. The plurality of recessed features are configured to attract at least some cracks that form in the PCD table. As such, the plurality of recessed features limit or prevent crack propagation into other portions of the PCD table and limit a volume of the PCD table that spalls. Methods of fabricating the PDCs include partially leaching the PCD table and, after leaching the PCD table, forming the plurality of recessed features in the upper surface thereof. Method of using the PDCs include rotating a PDC that has spalled relative to a
(Continued)

rotary drill bit such that a portion of the upper surface of the PDC that has not spalled forms a cutting surface thereof.

20 Claims, 25 Drawing Sheets

Related U.S. Application Data

(60) Provisional application No. 62/279,271, filed on Jan. 15, 2016.

(51) Int. Cl.

| | |
|---|---|
| ***E21B 10/62*** | (2006.01) |
| ***B24D 3/10*** | (2006.01) |
| ***E21B 10/567*** | (2006.01) |
| ***E21B 10/55*** | (2006.01) |
| ***E21B 10/633*** | (2006.01) |
| ***C22C 1/05*** | (2023.01) |
| ***C22C 1/051*** | (2023.01) |

(52) U.S. Cl.
CPC ..... *C22C 1/051* (2013.01); *E21B 10/55* (2013.01); *E21B 10/5673* (2013.01); *E21B 10/62* (2013.01); *E21B 10/633* (2013.01)

(56) References Cited

U.S. PATENT DOCUMENTS

| | | | | |
|---|---|---|---|---|
| 3,894,673 | A | 7/1975 | Lowder et al. | |
| 4,268,276 | A | 5/1981 | Bovenkerk | |
| 4,274,900 | A | 6/1981 | Mueller et al. | |
| 4,410,054 | A | 10/1983 | Nagel et al. | |
| 4,468,138 | A | 8/1984 | Nagel | |
| 4,560,014 | A | 12/1985 | Geczy | |
| 4,592,682 | A | 6/1986 | Vanistendael | |
| 4,629,373 | A | 12/1986 | Hall | |
| 4,738,322 | A | 4/1988 | Hall et al. | |
| 4,811,801 | A | 5/1989 | Salesky et al. | |
| 4,893,859 | A | 1/1990 | Nash | |
| 4,913,247 | A | 4/1990 | Jones | |
| 5,011,515 | A | 4/1991 | Frushour | |
| 5,016,718 | A | 5/1991 | Tandberg | |
| 5,054,246 | A | 10/1991 | Phaal et al. | |
| D324,056 | S | 2/1992 | Frazee | |
| D324,226 | S | 2/1992 | Frazee | |
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,172,778 | A | 12/1992 | Tibbitts et al. | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 5,601,477 | A | 2/1997 | Bunting et al. | |
| 5,662,720 | A | 9/1997 | O'Tighearnaigh | |
| 5,669,271 | A | 9/1997 | Griffin et al. | |
| 6,065,554 | A | 5/2000 | Taylor et al. | |
| 6,110,030 | A | 8/2000 | Hashimoto | |
| D436,820 | S | 1/2001 | Suzuki | |
| 6,302,410 | B1 | 10/2001 | Wentworth et al. | |
| 6,312,324 | B1 * | 11/2001 | Mitsui | B24D 18/00 451/540 |
| 6,338,754 | B1 | 1/2002 | Cannon et al. | |
| 6,793,681 | B1 | 9/2004 | Pope et al. | |
| D554,162 | S | 10/2007 | Hall et al. | |
| 7,464,973 | B1 | 12/2008 | Chapman et al. | |
| D594,486 | S | 7/2009 | Morozov | |
| 7,845,438 | B1 | 12/2010 | Vail et al. | |
| 7,866,418 | B2 | 1/2011 | Bertagnolli et al. | |
| 8,236,074 | B1 | 8/2012 | Bertagnolli et al. | |
| 8,261,858 | B1 | 9/2012 | Atkins et al. | |
| 8,297,382 | B2 | 10/2012 | Bertagnolli et al. | |
| 8,596,387 | B1 | 12/2013 | Sani et al. | |
| 8,734,552 | B1 | 5/2014 | Vail et al. | |
| D708,238 | S | 7/2014 | Matti | |
| 8,764,864 | B1 | 7/2014 | Miess et al. | |
| 8,807,247 | B2 | 8/2014 | Scott et al. | |
| 8,950,519 | B2 | 2/2015 | Gonzalez et al. | |
| 9,062,505 | B2 | 6/2015 | Chapman et al. | |
| 9,175,521 | B2 | 11/2015 | Bellin | |
| 9,260,923 | B1 | 2/2016 | Bertagnolli et al. | |
| 9,610,555 | B2 | 4/2017 | Mukhopadhyay et al. | |
| 9,623,542 | B1 | 4/2017 | Miess et al. | |
| 9,714,545 | B2 | 7/2017 | DiGiovanni et al. | |
| 9,732,563 | B1 | 8/2017 | Mukhopadhyay | |
| 9,650,839 | B1 | 9/2017 | Miess | |
| 9,759,015 | B2 | 9/2017 | Miess | |
| 9,844,854 | B1 | 12/2017 | Gleason et al. | |
| D835,163 | S | 12/2018 | Mortensen et al. | |
| 10,280,687 | B1 | 5/2019 | Mukhopadhyay | |
| 2009/0260877 | A1 | 10/2009 | Wirth | |
| 2010/0326740 | A1 | 12/2010 | Hall et al. | |
| 2011/0031036 | A1 | 2/2011 | Patel | |
| 2011/0073380 | A1 | 3/2011 | DiGiovanni | |
| 2011/0147083 | A1 | 6/2011 | Mauldin et al. | |
| 2011/0171414 | A1 | 7/2011 | Sreshta et al. | |
| 2012/0292188 | A1 | 11/2012 | Kim et al. | |
| 2012/0325563 | A1 | 12/2012 | Scott et al. | |
| 2013/0068534 | A1 | 3/2013 | DiGiovanni et al. | |
| 2013/0068537 | A1 | 3/2013 | DiGiovanni | |
| 2013/0263522 | A1 | 10/2013 | Nilen et al. | |
| 2013/0292188 | A1 | 11/2013 | Bilen et al. | |
| 2014/0318873 | A1 | 10/2014 | Patel et al. | |
| 2014/0366456 | A1 * | 12/2014 | Chapman | B23K 26/364 51/307 |
| 2014/0367177 | A1 | 12/2014 | Gonzalez et al. | |
| 2015/0266163 | A1 | 9/2015 | Stockey et al. | |
| 2015/0292272 | A1 | 10/2015 | Can et al. | |
| 2015/0298292 | A1 | 10/2015 | Can et al. | |
| 2018/0010396 | A1 | 1/2018 | Dunbar et al. | |

OTHER PUBLICATIONS

U.S. Appl. No. 12/961,787, filed Dec. 7, 2010, Mukhopadhyay et al.
U.S. Appl. No. 13/324,237, filed Dec. 13, 2011, Kidd et al.
U.S. Appl. No. 13/486,578, filed Jun. 1, 2012, Bertagnolli et al.
U.S. Appl. No. 13/734,354, filed Jan. 4, 2013, Linford et al.
U.S. Appl. No. 13/790,046, filed Mar. 8, 2013, Cox.
U.S. Appl. No. 61/948,970, filed Mar. 6, 2014, Knuteson et al.
U.S. Appl. No. 14/273,360, filed May 8, 2014, Burton et al.
U.S. Appl. No. 14/275,574, filed May 12, 2014, Burton et al.
U.S. Appl. No. 62/002,001, filed May 22, 2014, Knuteson et al.
U.S. Appl. No. 14/627,966, filed Feb. 20, 2015, Linford et al.
U.S. Appl. No. 14/811,699, filed Jul. 28, 2015, Myers et al.
U.S. Appl. No. 62/232,732, filed Sep. 25, 2015, Weaver et al.
U.S. Appl. No. 62/279,271, filed Jan. 15, 2016, Mortensen et al.
U.S. Appl. No. 29/559,713, filed Mar. 30, 2016, Mortensen et al.
U.S. Appl. No. 61/891,525, filed Oct. 16, 2013, Miess.
U.S. Appl. No. 14/515,768, filed Oct. 16, 2014, Mortensen et al.
U.S. Appl. No. 15/402,525, filed Jan. 10, 2017, Mortensen et al.
U.S. Appl. No. 16/008,935, filed Jun. 14, 2018, Miess.
U.S. Appl. No. 14/515,768, Jan. 29, 2016, Restriction Requirement.
U.S. Appl. No. 14/515,768, May 31, 2016, Office Action.
U.S. Appl. No. 14/515,768, Nov. 14, 2016, Office Action.
U.S. Appl. No. 14/515,768, Feb. 3, 2017, Advisory Action.
U.S. Appl. No. 14/515,768, Mar. 6, 2017, Office Action.
U.S. Appl. No. 14/515,768, Jul. 13, 2017, Office Action.
U.S. Appl. No. 14/515,768, Nov. 24, 2017, Notice of Allowance.
U.S. Appl. No. 14/515,768, Mar. 15, 2018, Notice of Allowance.
U.S. Appl. No. 14/515,768, Jun. 27, 2018, Issue Notification.
U.S. Appl. No. 29/559,713, Jan. 29, 2018, Restriction Requirement.
U.S. Appl. No. 29/559,713, Jul. 19, 2018, Notice of Allowance.
U.S. Appl. No. 29/559,713, Nov. 14, 2018, Issue Notification.
U.S. Appl. No. 14/402,525, Sep. 19, 2018, Office Action.
U.S. Appl. No. 15/402,525, Feb. 13, 2019, Office Action.
U.S. Appl. No. 15/402,525, Apr. 24, 2019, Notice of Allowance.

(56) References Cited

OTHER PUBLICATIONS

U.S. Appl. No. 15/402,525, Aug. 14, 2019, Issue Notification.
U.S. Appl. No. 16/008,935, Aug. 18, 2020, Notice of Allowance.
U.S. Appl. No. 16/008,935, Nov. 9, 2020, Corrected Notice of Allowance.

* cited by examiner

POLYCRYSTALLINE DIAMOND COMPACTS, METHODS OF FABRICATING THE SAME, AND METHODS OF USING THE SAME

CROSS-REFERENCE TO RELATED APPLICATION(S)

This application is a divisional of U.S. application Ser. No. 15/402,525 filed on 10 Jan. 2017, which claims priority to U.S. Provisional Application No. 62/279,271 filed on 15 Jan. 2016, the disclosure of each of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process that sinters diamond particles under diamond-stable conditions. The PDC cutting element may also be brazed directly into a preformed pocket, socket, or other receptacle formed in a bit body. The substrate may optionally be brazed or otherwise joined to an attachment member, such as a cylindrical backing. A rotary drill bit typically includes a number of PDC cutting elements affixed to the bit body. It is also known that a stud carrying the PDC may be used as a PDC cutting element when attached to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In a conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT sintering process. The cobalt acts as a catalyst to promote intergrowth between the diamond particles, which results in formation of a matrix of bonded diamond grains having diamond-to-diamond bonding there between, with interstitial regions between the bonded diamond grains being occupied by the solvent catalyst.

The presence of the metal-solvent catalyst in the PCD table is believed to reduce the thermal stability of the PCD table at elevated temperatures. For example, the difference in thermal expansion coefficient between the diamond grains and the metal-solvent catalyst is believed to lead to chipping or cracking of the PCD table during drilling or cutting operations, which can degrade the mechanical properties of the PCD table or cause failure. Additionally, some of the diamond grains can undergo a chemical breakdown or back-conversion to graphite via interaction with the solvent catalyst. At elevated high temperatures, portions of diamond grains may transform to carbon monoxide, carbon dioxide, graphite, or combinations thereof, thereby degrading the mechanical properties of the PDC.

One conventional approach for improving the thermal stability of a PDC is to at least partially remove the metal-solvent catalyst from the PCD table of the PDC by acid leaching. Another approach involves infiltrating and bonding an at least partially leached PCD table to a cemented carbide substrate with a metallic infiltrant, and acid leaching to at least partially remove the metallic infiltrant.

Despite the availability of a number of different PDCs, manufacturers and users of PDCs continue to seek PDCs that exhibit improved toughness, wear resistance, and thermal stability.

SUMMARY

PDCs, methods of fabricating the PDCs, and methods of using the PDCs are disclosed herein. The PDCs include a PCD table bonded to a substrate. The PCD table includes an upper surface having a plurality of recessed features formed therein. The plurality of recessed features function as stress concentrations that are configured to attract at least some cracks that form in the PCD table. As such, the plurality of recessed features limit or prevent propagation of the cracks into other portions of the PCD table and limit a volume of the PCD table that spalls during cutting operations. Methods of fabricating the PDCs include partially leaching the PCD table and, after leaching the PCD table, forming the plurality of recessed features in the upper surface thereof. Method of using the PDCs include rotating a PDC that has spalled relative to a rotary drill bit such that a portion of the upper surface of the PDC that has not spalled forms a cutting surface thereof. The disclosed PDCs may be used in a variety of applications, such as rotary drill bits, machining equipment, and other articles and apparatuses.

In an embodiment, a PDC is disclosed. The PDC includes a substrate. The PDC also includes a PCD table bonded to the substrate. The PCD table includes an interfacial surface bonded to the substrate, an upper surface spaced from the interfacial surface, and at least one lateral surface extending between the upper surface and the interfacial surface. The PCD table also includes a plurality of diamond grains bonded together defining a plurality of interstitial regions. The PCD table further includes an unleached region bonded to the interfacial surface. The unleached region includes at least one interstitial constituent disposed in at least a portion of the plurality of interstitial regions thereof. The PCD table also includes a leached region extending inwardly from the upper surface and at least a portion of the at least one lateral surface. The leached region is at least partially depleted of the at least one interstitial constituent. The PCD table additionally includes a plurality of recessed features extending from the upper surface through a portion of the polycrystalline diamond table. A majority of the plurality of recessed features do not extend into the unleached region.

In an embodiment, a method of fabricating a PDC is disclosed. The method includes leaching at least a portion of at least one interstitial constituent from a polycrystalline diamond table to a leach depth measured inwardly from an upper surface and at least one lateral surface of the polycrystalline diamond table to form a leached region. The method also includes, after leaching the polycrystalline diamond table, forming a plurality of recessed features that extend from the upper surface of the polycrystalline diamond table to a depth less than the leach depth of the leached region. Forming the plurality of recessed features forms a plurality of cells on the upper surface that are at least partially defined by the plurality of recessed features.

In an embodiment, a method of using a PDC is disclosed. The method includes decoupling at least one PDC from a drill bit body. The at least one PDC includes a PCD table bonded to a substrate. A portion of the PCD table includes a spalled region. The PCD table includes an interfacial surface bonded to the substrate, an upper surface spaced from the interfacial surface, and at least one lateral surface extending between the upper surface and the interfacial surface. The PCD table also includes a plurality of diamond grains bonded together defining a plurality of interstitial regions. The PCD table further includes a plurality of recessed features extending from the upper surface of the polycrystalline diamond table through a portion of the polycrystalline diamond table. At least one of the plurality of recessed features partially defines the spall region. Additionally, the PCD table includes an unleached region bonded to the interfacial surface. The unleached region includes an interstitial constituent disposed in at least a portion of the plurality of interstitial regions thereof. Finally, the PCD table includes a leached region extending inwardly from the upper surface and at least a portion of at least one lateral surface. The leached region is at least partially depleted of at least one interstitial constituent. A majority of the plurality of recessed features do not extend into the unleached region. The method also includes rotating the at least one PDC relative to the drill bit body to position a portion of the PCD table that does not include the spalled region in a cutting position. The method further includes coupling the at least one PDC to the drill bit body with the PCD table positioned in the cutting position.

In an embodiment, a PDC includes a substrate and a PCD table bonded to the substrate. The PCD table includes an interfacial surface bonded to the substrate, an upper surface spaced from the interfacial surface, and at least one lateral surface extending between the upper surface and the interfacial surface. The PCD table further includes a plurality of diamond grains bonded together defining a plurality of interstitial regions. The PCD table also includes an unleached region bonded to the interfacial surface, with the unleached region including at least one interstitial constituent disposed in at least a portion of the plurality of interstitial regions thereof; a leached region extending inwardly from the upper surface and at least a portion of the at least one lateral surface, with the leached region being at least partially depleted of the at least one interstitial constituent; and a plurality of recessed features extending from the upper surface through a portion of the PCD table, with the plurality of recessed features forming a plurality of cells. An initial spallation of the PCD table in response to a milling spallation test is about 10% or less of the area of the upper surface of the PCD table.

In an embodiment, a PDC includes a substrate and a PCD table bonded to the substrate. The PCD table includes an interfacial surface bonded to the substrate, an upper surface spaced from the interfacial surface, and at least one lateral surface extending between the upper surface and the interfacial surface. The PCD table further includes a plurality of diamond grains bonded together defining a plurality of interstitial regions. The PCD table also includes a plurality of recessed features extending from the upper surface through a portion of the PCD table; an unleached region bonded to the interfacial surface, with the unleached region including at least one interstitial constituent disposed in at least a portion of the plurality of interstitial regions thereof; and a leached region extending inwardly from the upper surface and at least a portion of the at least one lateral surface, with the leached region being at least partially depleted of the at least one interstitial constituent. The PCD table exhibits a probability of failure less than about 0.4 at a distance cut of at least about 325 inches when tested in a milling spallation test.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

PDCs, methods of fabricating the PDCs, and methods of using the PDCs are disclosed herein. The PDCs include a PCD table bonded to a substrate. The PCD table includes an upper surface having a plurality of recessed features formed therein. The plurality of recessed features function as stress concentrations that are configured to attract at least some cracks that form in the PCD table. As such, the plurality of recessed features limit or prevent propagation of the cracks into other portions of the PCD table and limit a volume or area of the PCD table that spalls during cutting operations. Methods of fabricating the PDCs include partially leaching the PCD table and, after leaching the PCD table, forming the plurality of recessed features in the upper surface thereof. Method of using the PDCs include rotating a PDC that has spalled relative to a rotary drill bit such that a portion of the upper surface of the PDC that has not spalled forms a cutting surface thereof. The disclosed PDCs may be used in a variety of applications, such as rotary drill bits, machining equipment, and other articles and apparatuses.

Figure 1A:
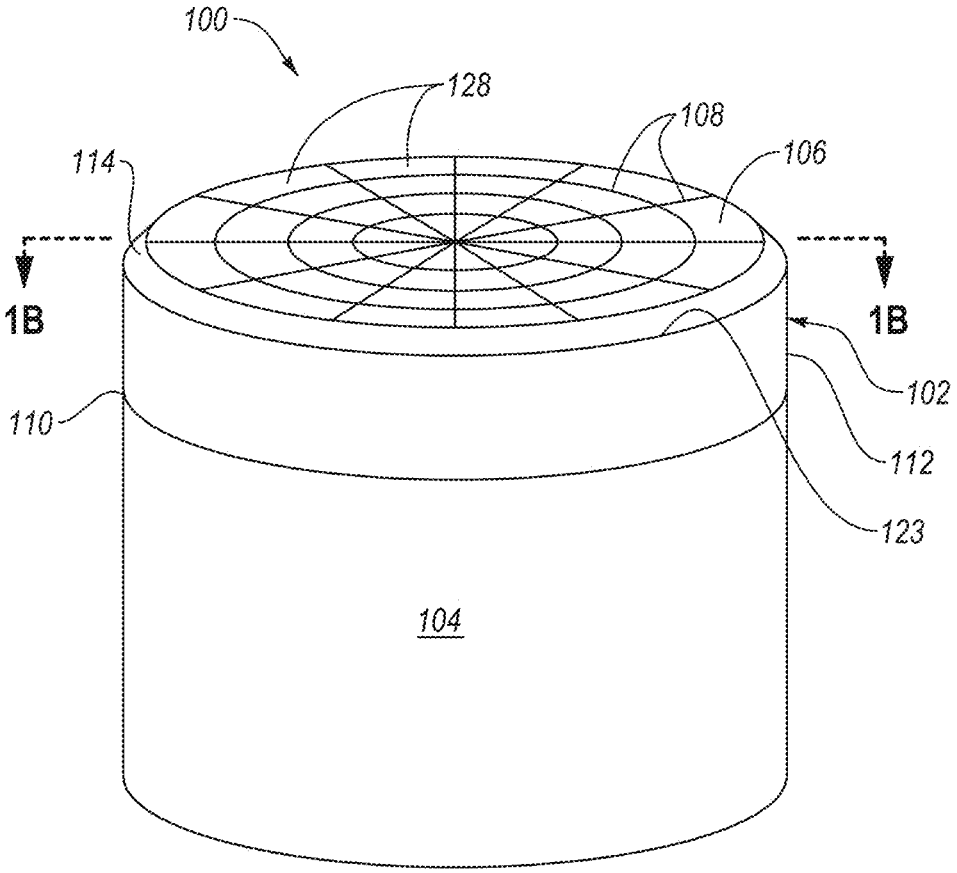
FIG. 1A is an isometric view of a PDC, according to an embodiment.

FIG. 1A is an isometric view of a PDC 100, according to an embodiment. The PDC 100 includes a PCD table 102 bonded to a substrate 104. The PCD table 102 includes an upper surface 106 that forms at least part of a working surface of the PDC 100. The upper surface 106 includes a plurality of recessed features 108 (e.g., grooves) formed therein. In an embodiment, during cutting operations using the PDC 100, cracks may form in the PCD table 102. The plurality of recessed features 108 function as stress concentrations that are configured to attract cracks thereto, thereby limiting crack propagation into the PCD table 102 during cutting operations. As such, the plurality of recessed features 108 may limit spalling to a limited region of the PCD table 102 ("spalled region"). Additionally, the plurality of recessed features 108 limit crack propagation from the spalled region to other regions of the PCD table 102. In an embodiment, the plurality of recessed features 108 may be sized and configured to limit a spalled region to 10% or less, 5% of less, 4% or less, or 3% or less, about 3% to about 10%, about 5% to about 8%, or about 4% to about 7% of a total surface area of the upper surface 106. As such, the plurality of recessed features 108 may help maintain one or more of a structural integrity, a strength, or a toughness of the PCD table 102.

In some embodiments, a probability of failure as determined in a milling spallation test, which is described in comparative example 1 below, may be less than about 0.1 at a distance cut of about 315 inches or greater (e.g., about 315 inches to about 325 inches, about 325 inches to about 350, about 350 inches or greater), may be less than about 0.3 to about 0.4 at a distance cut of about 325 inches or greater (e.g., about 325 inches to about 350 inches, about 350 inches to about 375 inches, at least about 350 inches, at least about 375 inches, about 375 inches to about 400 inches, or greater than 400 inches), may be less than about 0.75 at a distance cut of about 340 inches or greater (e.g., about 350 inches to about 375 inches, about 375 inches to about 400 inches, about 400 inches to about 425 inches, about 425 inches or greater).

The substrate 104 may include a cemented carbide material. For example, the substrate 104 may include tungsten carbide, titanium carbide, chromium carbide, niobium carbide, tantalum carbide, vanadium carbide, or combinations thereof that may be cemented with iron, nickel, cobalt, combinations thereof, or alloys thereof. For example, the substrate 104 may comprise a cobalt-cemented tungsten carbide. In some embodiments, the substrate 104 may be omitted (e.g., a free-standing PCD table).

The PCD table 102 includes an interfacial surface 110 that is spaced from the upper surface 106 and bonded to the substrate 104. The interfacial surface 110 may be substantially planar (FIG. 1B), exhibit a concave or convex curvature, or have one or more recesses and/or protrusions formed therein. The substrate 104 may include a surface that substantially corresponds to the interfacial surface 110. The PCD table 102 may also include at least one lateral surface 112 that extends from the interfacial surface 110 to the upper surface 106. In some embodiments, the PCD table 102 may include an optional chamfer 114 extending between the at least one lateral surface 112 and the upper surface 106. In other embodiments, the PCD table 102 may include a rounded edge, multiple chamfers (e.g., double chamfer), or any other suitable edge geometry.

Figure 1B:
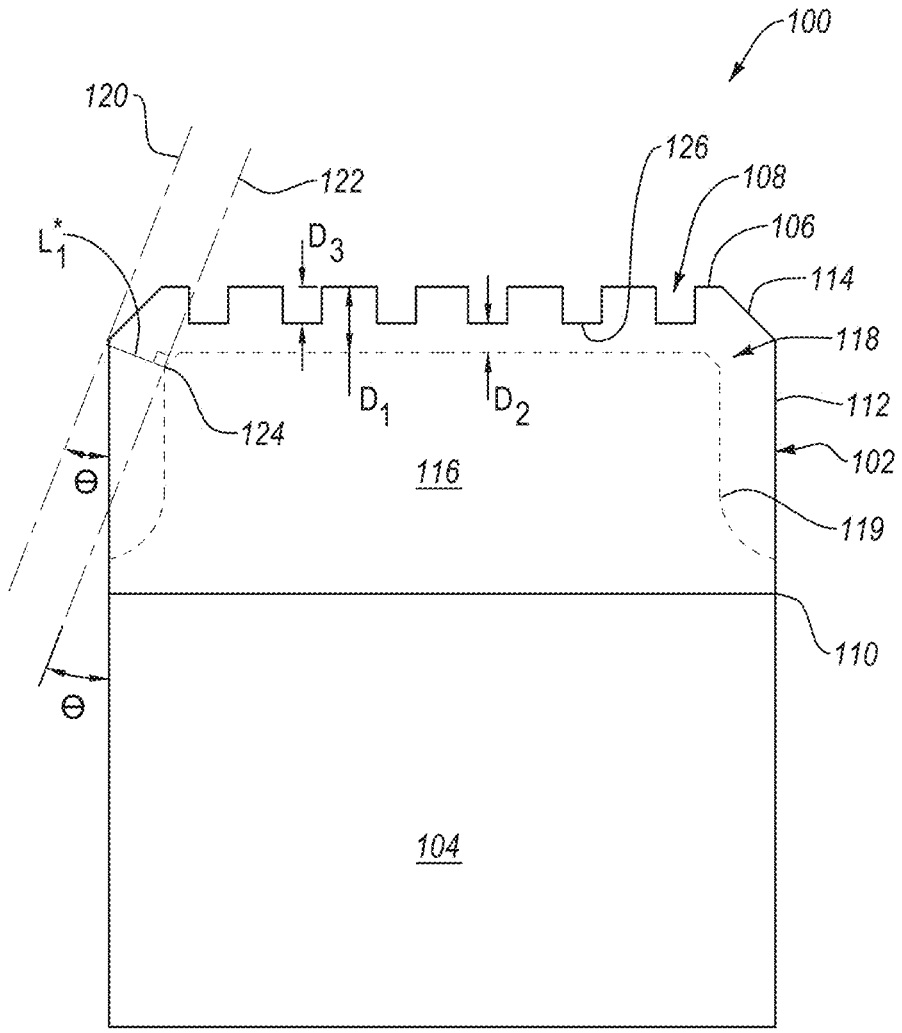
FIG. 1B is a side, cross-sectional view of the PDC shown in FIG. 1A taken along plane 1B-1B thereof.

In the illustrated embodiments shown in FIGS. 1A-1B, the PDCs are cylindrical. However, in other embodiments, the PDCs disclosed herein may exhibit other suitable configurations (e.g., triangular, rectangular, elliptical, or other suitable configuration) that may exhibit one or more peripheral surfaces or sides.

The PCD table 102 includes a plurality of directly bonded together diamond grains that exhibit diamond-to-diamond bonding therebetween (e.g., $sp^3$ bonding). The plurality of directly bonded together diamond grains define a plurality of interstitial regions therebetween. The PCD table 102 may include at least one interstitial constituent that at least partially occupies at least some of the interstitial regions of the PCD table 102. The at least one interstitial constituent may include at least one of a metal-solvent catalyst (e.g., cobalt, iron, nickel, combinations thereof, or alloys thereof), at least one constituent from the substrate (e.g., tungsten and/or tungsten carbide), a nonmetallic catalyst (e.g., one or more alkali metal carbonates, one or more alkaline metal carbonates, one or more alkaline earth metal hydroxides, or combinations thereof), or another suitable interstitial constituent.

The at least one interstitial constituent may be at least partially leached from the PCD table 102. For example, FIG. 1B is a side, cross-sectional view of the PDC 100 shown in FIG. 1A taken along plane 1B-1B thereof. The PCD table 102 includes an unleached region 116 that is bonded to the substrate 104. The unleached region 116 may extend from the interfacial surface 110 towards the upper surface 106. The unleached region 116 is a portion of the PCD table 102 that is not leached and includes the at least one interstitial constituent therein that at least partially occupies (e.g., at least substantially occupies) at least some of the interstitial regions thereof.

Figure 2:
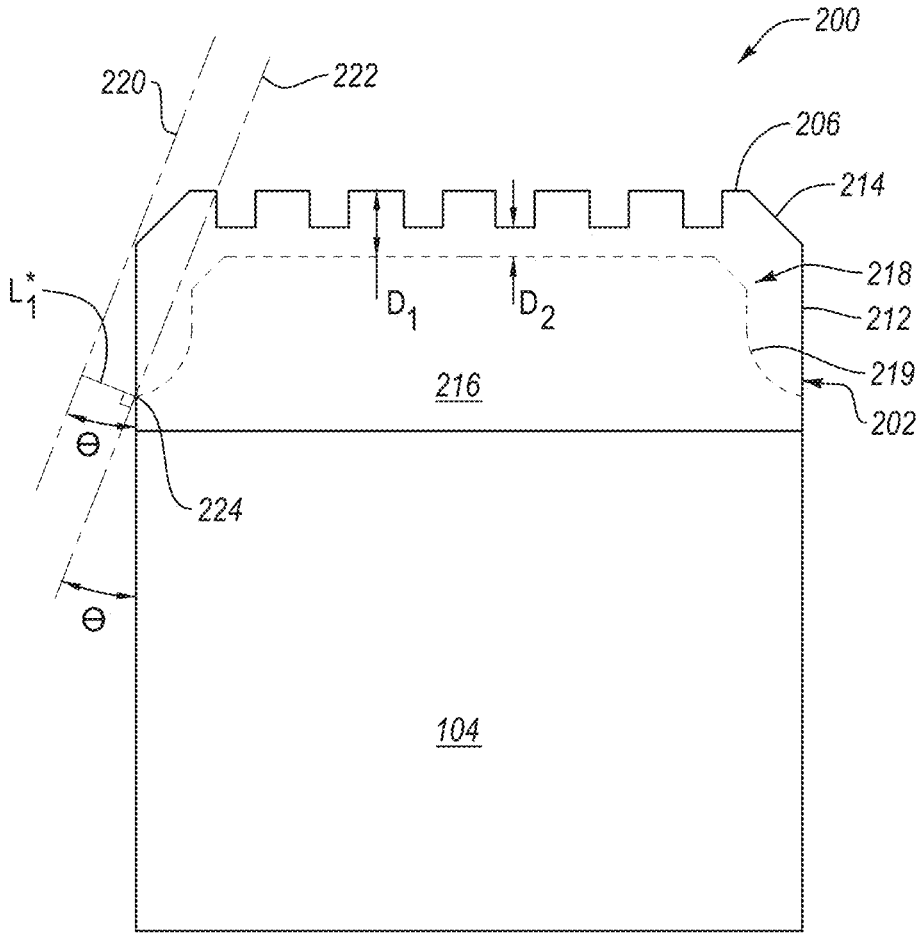
FIG. 2 is a side, cross-sectional view of a PDC that includes a partially leached PCD table, according to an embodiment.

The PCD table 102 also includes a leached region 118 that extends inwardly from the upper surface 106, at least a portion of the at least one lateral surface 112, and the optional chamfer 114. For example, an interface 119 is located between the leached region 118 and the unleached region 116. The leached region 118 includes at least some of the at least one interstitial constituent removed from the interstitial regions thereof (e.g., the leached region 118 exhibits a lower concentration of the at least one interstitial constituent than the unleached region 116). For example, a residual amount of the at least one interstitial constituent may still remain in the interstitial regions of the leached region 118 after leaching. The residual amount of the at least one interstitial constituent in the interstitial regions of the leached region 118 may be about 0.5% to about 2% by weight (e.g., about 0.8% to about 1.2% by weight), or less than about 0.5% by weight (e.g., substantially completely removed from the interstitial regions of the leached region 118). In an embodiment, the leached region 118 may extend inwardly along at least about 50% of a length of the at least one lateral surface 112 (i.e., from the interfacial surface 110 to a bottommost edge 123 of the chamfer 114), such as along at least about 75% of the at least one lateral surface 112, along at least about 80% of the at least one lateral surface 112, or along at least about 90% of the at least one lateral surface 112. As will be discussed later, increasing the percentage of the at least one lateral surface 112 that is leached may allow the $L_1$* value to increase (FIG. 2).

The leached region 118 may exhibit a first leach depth $D_1$ measured substantially perpendicularly inwardly from the upper surface 106 to the interface 119 between the leached region 118 and the unleached region 116. The first leach depth $D_1$ may be about 200 μm to about 900 μm. For example, the first leach depth $D_1$ may be about 200 μm to about 400 μm, about 400 μm to about 500 μm, about 500 μm to about 800 μm, about 800 μm to about 900 μm, less than 200 μm, or greater than 900 μm. In an embodiment, the first leach depth $D_1$ may be substantially uniform along a selected length of the upper surface 106. In an embodiment, the first leach depth $D_1$ may vary long a selected length of the upper surface 106. For example, as will be discussed in more detail below, the first leach depth $D_1$ may be greater at and/or near an edge of the upper surface 106 (e.g., where the upper surface 106 meets the at least one lateral surface 112, the chamfer 114, etc.) than a location spaced from the edge of the upper surface 106. The leached region 118 may also exhibit leach depths measured substantially perpendicularly inwardly from the chamfer 114 and the at least one lateral surface 112, respectively. In an embodiment, the leach depth measured substantially perpendicularly inwardly from at least a portion of the chamfer 114 and at least a portion of the at least one lateral surface 112 may be substantially the same as or similar to the first leach depth $D_1$. In another embodiment, the leached depth measured substantially perpendicularly inwardly from at least a portion of the chamfer 114 and/or a portion of the at least one lateral surface 112 may be different than the first leach depth $D_1$. For example, the leach depth measured substantially perpendicularly inwardly from a portion of the at least one lateral surface 112 may be greater than the first leach depth $D_1$. Additional examples of leach profiles that the leached region 118 may exhibit are disclosed in U.S. Pat. No. 8,596,387, the disclosure of which in incorporated herein, in its entirety, by this reference.

The leach profile (e.g., the leach depth measured inwardly from the upper surface 106, the at least one lateral surface 112, and/or the optional chamfer 114) may be used to predict when the PDC 100 spalls. FIG. 1B illustrates a predicted initial wear front 120 before the PDC 100 has been used and experienced wear. The predicted initial wear front 120, in an embodiment, may be represented as an idealized, hypothetical plane that extends at an angle θ relative to the at least one lateral surface 112. The angle θ may be about 10° to about 30°, such as about 20°. The predicted initial wear front 120 also exhibits a single point of tangency with a portion of the PCD table 102. For example, in the illustrated embodiment, the predicted initial wear front 120 may intersect (e.g., at a single point) with a bottommost edge 123 of the chamfer 114. In another example, the predicted initial wear front 120 may intersect (e.g., at a single point) an outer edge of the upper surface 106, one or more portions of the upper surface 106 (e.g., the upper surface 106 exhibits a convex curvature), or any other portion or portions of the PDC 100.

During operation, portions of the PCD table 102 may generally wear away along an expected wear front 122. In an embodiment, the expected wear front 122 may be assumed to be generally parallel to the predicted initial wear front 120. In such an embodiment, the expected wear front 122 may be a plane that extends at the angle θ relative to the at least one lateral surface 112. The inventors currently believe that at least of one or more microscopic cracks or other defect forms near the interface 119 between the leached region 118 and the unleached region 116 when the expected wear front 122 extends through the leached region 118 and contacts the unleached region 116. The inventors currently believe that the cracks and/or other defect(s) may form a leach boundary-wear intersection location 124 that increases a likelihood that the PCD table 102 spalls.

The PCD table 102 may be expected to spall in response to the expected wear front 122 intersecting with the interface 119 between the unleached region 116 and the leached region 118 (e.g., the first location where the leach boundary-wear intersection location 124 may form). The shortest distance measured substantially perpendicularly from the predicted initial wear front 120 (e.g., having an angle θ of about 20°) and the interface 119 is referred to as the $L_1$* value (e.g., the distance measured substantially perpendicularly between the predicted initial wear front 120 and the subsequent expected wear front 122 intersecting with the interface 119). In other words, the $L_1$* value is the expected amount of wear into the PCD table 102 before the PCD table 102 becomes more susceptible to spallation. In the illustrated embodiment, the $L_1$* value is measured between the predicted initial wear front 120 and a portion of the interface 119 that is spaced from the at least one lateral surface 112.

The leach profile of the leached region 118 may be configured to maximize the $L_1$* value. For example, in the illustrated embodiment, increasing one or more of the first leach depth $D_1$, the leach depth measured inwardly from the chamfer 114, or the leach depth measured inwardly from the at least one lateral surface may increase the $L_1$* value. In particular, increasing the leach depth measured inwardly from of the at least one lateral surface may increase the $L_1$* value more than increasing the first leach depth $D_1$. Additionally, forming the chamfer 114 in the PCD table 102 prior leaching the PCD table 102 may also increase the $L_1$* value. In an embodiment, the $L_1$* value may be about 50 μm to about 1200 μm. For example, the $L_1$* value may be about 100 μm to about 600 μm, about 100 μm to about 250 μm, about 250 μm to about 500 μm, 500 μm to about 750 μm, or about 750 μm to about 1000 μm. In an embodiment, the $L_1$* value may be less than 50 μm or greater than 1200 μm.

As previously discussed, the PCD table 102 includes the plurality of recessed features 108 formed in the upper surface 106. At least a portion of the plurality of recessed features 108 may also be formed in the at least one lateral surface 112 and/or the chamfer 114. The plurality of recessed features 108 are configured to limit crack propagation and/or spallation in the PCD table 102. In particular, a crack in the PCD table 102 (e.g., formed at the leach boundary-wear intersection location 124) may be attracted to the nearest recessed feature 108 because the nearest recessed feature 108 serves as a stress concentration and a path of least resistance for crack propagation thereto. As such, the plurality of recessed features 108 may limit crack propagation into other regions of the PCD table 102, thereby maintaining a strength and/or a toughness of the other regions of the PCD table 102. For example, a crack may cause a portion of the PCD table 102 to spall. However, since the crack may be attracted to nearby recessed feature 108, the plurality of recessed features 108 may limit the amount of the PCD table 102 that spalls. For instance, at least a portion at least one of the plurality of recessed features 108 may at least partially define a spalled region or area formed in the PCD table 102. The spalled region may be less than 10% the total area of the upper surface 106, such as less than 5%, less than 4%, less than 3%, less than 2%, less than 1%, or less than 5% of a total surface area of the upper surface 106.

Each of the plurality of recessed features 108 includes a base 126 that partially defines each recessed feature 108. The base 126 is the portion of each of the plurality of recessed features 108 that is farthest spaced from the upper surface 106. A depth $D_3$ of each of the plurality of recessed features 108 is measured substantially perpendicularly from the upper surface 106 (e.g., an imaginary continuation of the upper surface 106 that extends over the recessed feature 108) to the base 126. In an embodiment, the depth $D_3$ of each of the plurality of recessed features 108 may be about 50 μm to about 500 μm, such as about 50 μm to about 150 μm, 100 μm to about 250 μm, 200 μm to about 400 μm, or about 300 μm to about 500 μm. In an embodiment, the depth $D_3$ of each of the plurality of recessed features 108 may be less than about 50 μm or greater than 500 μm. The depth $D_3$ of each of the plurality of recessed features 108 may be selected based on a width or area of the respective recessed feature 108, the cross-sectional shape (in side view) of the respective recessed feature 108, the first leach depth $D_1$, the $L_1$* value, the shortest distance between the leach boundary-wear intersection location 124 and the respective recessed feature 108, the application of the PDC 100, etc.

In an embodiment, the plurality of recessed features 108 may potentially adversely affect the strength and toughness of the PCD table 102. For example, the strength and/or toughness of the PCD table 102 may decrease as an average depth of the plurality of recessed features 108 increases. However, the ability of the plurality of recessed features 108 to attract cracks thereto may also increase as the average depth of the plurality of recessed features 108 increases. For example, a recessed feature 108 that is positioned proximate to the leach boundary-wear intersection location 124 or that exhibits a relatively high stress concentration factor may exhibit a depth that is relatively shallow (e.g., about 50 μm to about 250 μm). In another embodiment, a recessed feature 108 that is spaced from leach boundary-wear intersection location 124 or that exhibits a relatively low stress concentration factor may exhibit a depth that is relatively deep (e.g., about 250 μm to about 500 μm, greater than 500 μm).

In an embodiment, at least some of the plurality of recessed features 108 only extend partially through or within the leached region 118. As such, the leach depth of the remaining leached region 118 proximate to the at least some of the plurality of recessed features 108 may be decreased. For example, the leached region 118 may exhibit a second leach depth $D_2$ measured substantially perpendicularly inwardly from the base 126 of each of the at least some of the plurality of recessed features 108 to the interface 119 between the leached region 118 and the unleached region 116. In an embodiment, the second leach depth $D_2$ may be about 1% to about 75% less than the first leach depth $D_1$. For example, the second leach depth $D_2$ may be about 1% less than to about 5% less than, about 5% less than to about 25% less than, about 20% less than to about 40% less than, about 25% less than to about 50% less than, or about 50% less than to about 75% less than the first leach depth $D_1$. For example, if $D_1$ equals about 500 μm, then $D_2$ may be about 20% less than to about 40% less than $D_1$ (i.e., 300 μm to about 400 μm). In another embodiment, the second leach depth $D_2$ may be greater than 0% to about 1% less than the first leach depth $D_1$, about 75% less than the first leach depth $D_1$ to completely through the leached region 118, or about 75% less than the first leach depth $D_1$ to substantially through the PCD table 102. As previously discussed, the percentage of the second leach depth $D_2$ to the first leach depth $D_1$ may potentially affect the performance of the PDC 100. For example, the second leach depth $D_2$ of at least some of the plurality of recessed features 108 may be significantly less than the first leach depth $D_1$ (e.g., about 50% to about 75% less than the first leach depth $D_1$) when the recessed features 108 are positioned proximate to the anticipated leach boundary-wear intersection location 124 and/or exhibits a relatively high stress concentration factor.

In an embodiment, the first leach depth $D_1$ may be about 1.33 to about 20 times greater than the depth $D_3$ of at least some of the plurality of recessed features 108. For example, the first leach depth $D_1$ may be about 1.5 to about 5, about 2 to about 10, about 5 to about 15, about 10 to about 15, or about 15 to about 20 times greater than the depth $D_3$ of at least some of the plurality of recessed features 108. In an embodiment, the first leach depth $D_1$ may be about 1.0 to about 1.33 times greater or more than 20 times greater than depth $D_3$ of at least some of the plurality of recessed features 108. In an embodiment, the depth $D_3$ of at least some of the plurality of recessed features 108 may be greater than the first leach depth $D_1$. As previously discussed, the depth $D_3$ of the plurality of recessed features 108 relative to the first leach depth $D_1$ may affect to the performance of the PDC 100. For example, the first leach depth $D_1$ may be at least about 4 times greater than the depth $D_3$ of at least some of the plurality of recessed features 108 when the recessed features 108 are positioned proximate to the anticipated leach boundary-wear intersection location 124 and/or exhibits a relatively high stress concentration factor.

In an embodiment, the depth $D_3$ of at least some of the plurality of recessed features 108 may vary with location along the upper surface 106. For example, the depth of at least some of the plurality of recessed features 108 may generally increase, decrease, undulate, or vary from a location on the upper surface 106 (e.g., a center of the upper surface 106) towards an edge of the upper surface 106. For example, the depth $D_3$ of at least some of the plurality of recessed features 108 may be greatest at and/or near the edge of the upper surface 106. As another example, the depth $D_3$ of at least some of the plurality of recessed features 108 may be smallest at and/or near the edge of the upper surface 106. In an embodiment, the depth $D_3$ of at least some of the plurality of recessed features 108 may be greatest at, near, and/or inwardly from a location where the expected wear front 122 contacts the unleached portion 116. Varying the depth $D_3$ of at least some of the plurality of recessed features 108 may increase the overall strength and toughness of the PCD table 102 because the average depth of the plurality of recessed features 108 is less than the greatest depth of the plurality of recessed features 108. However, the depth of the plurality of recessed features 108 may be sufficiently deep at certain locations to limit a spalled region formed in the PCD table 102.

In an embodiment, the plurality of recessed features 108 may be formed in only a selected portion of the upper surface 106. Forming the plurality of recessed features 108 in a selected portion of the upper surface 106 may increase the strength and toughness the PCD table 102. For example, the plurality of recessed features 108 may be formed in a radially outer half of the upper surface 106. The plurality of recessed features 108 may be formed in the radially outer half of the upper surface 106 because the leach boundary-wear intersection location 124 may be more likely to occur in the radially outer half of the PCD table 102. In an embodiment, the plurality of recessed features 108 may be formed over the entire upper surface 106 (e.g., uniformly formed on the upper surface 106). For example, forming recessed features 108 in the radially inner half of the upper surface 106 may act as a redundant spallation limiting structure for the plurality of recessed features 108 formed in the radially outer half of the upper surface 106.

In an embodiment, at least some of the plurality of recessed features 108 may extend to an outer edge of the upper surface 106. However, at least some of the plurality of recessed features 108 may extend to other portions of the PCD table 102. For example, at least some of the plurality of recessed features 108 may extend from a location on the upper surface 106 to a location inwardly from outer edge of the upper surface 106. In another example, at least some of the plurality of recessed features 108 may extend from a location on the upper surface 106 to a location beyond the outer edge of the upper surface 106, such as to a location on the chamfer 114 or a location on the at least one lateral surface 112.

The ability of the plurality of recessed features 108 to attract cracks and/or limits spallation may be dependent on the plurality of recessed features' 108 stress concentration factor. In an embodiment, the stress concentration factor of the plurality of recessed features 108 may increase as a ratio of the average depth of the plurality of recessed features 108 to an average width of the plurality of recessed features 108 increases. For example, the ratio may be at least about 1, at least about 1.5, at least about 2, at least about 3, or about 1.5 to about 3.

The plurality of recessed features 108 may exhibit a spacing therebetween configured to cause cracks formed at or near the leach boundary-wear intersection location 124 to be attracted to the nearest recessed feature 108. In an embodiment, two substantially similar immediately adjacent recessed features may be substantially parallel along a selected length thereof. The distance between the substantially parallel lengths of the two immediately adjacent recessed features may be less than about 3 mm, such as less than about 2 mm, less than about 1 mm, about 1 mm to about 3 mm, or about 0.5 mm to about 2 mm. The inventors have found that the two recessed features can exhibit a microscopic spacing therebetween and a propagating crack is still attracted to the nearest recessed feature. In particular, the inventors have found that the two recessed features may exhibit a spacing therebetween of about 650 μm or less (e.g., about 625 μm or less, about 600 μm or less, about 500 μm or less, about 400 μm or less, about 300 μm or less, or about 250 μm or less, about 250 μm to about 500 μm, or about 300 μm to about 500 μm) and the propagating crack can still be attracted to the nearest recessed feature.

Referring to FIG. 1A, the upper surface 106 may include a plurality of cells 128 (e.g., closed cells or partially closed cells) formed therein. The plurality of cells 128 may be at least partially defined by the plurality of recessed features 108. At least some of the plurality of cells 128 may also be partially defined by at least one of the at least one lateral surface 112 and/or the optional chamfer 114. Each of the plurality of cells 128 may define a portion of the upper surface 106 that may break from the upper surface 106 when the PCD table 102 spalls. As such, each of the plurality of cells 128 may be configured to limit a volume or area of the upper surface 106 that breaks from the upper surface 106. For example, the plurality of cells 128 may exhibit an average surface area that is less than about 5% of the surface area of the upper surface 106. For example, the plurality of cells 128 may exhibit an average surface area that is less than about 4%, less than about 3%, less than about 2%, less than about 1%, or about 1% to about 5% of the surface area of the upper surface 106. For example, the plurality of cells may exhibit an average surface area that is greater than about 20 $mm^2$, about 0.25 $mm^2$ to about 20 $mm^2$, about 10 $mm^2$ to about 15 $mm^2$, about 5 $mm^2$ to about 10 $mm^2$, about 1 $mm^2$ to about 5 $mm^2$, about 2 $mm^2$ to about 4 $mm^2$, or about 0.5 $mm^2$ to about 3 $mm^2$. As such, when one or more of the plurality of cells 128 break from the upper surface 106, the percentage of the total surface area of the upper surface 106 (prior to any wear, damage, or spallation) that breaks away is less than about 5%, less than about 7.5%, less than about 10%, less than about 12.5%, less than about 15%, less than about 20%, less than about 25%, about 5% to about 15%, about 5% to about 10%, about 10% to about 20%, or about 15% to about 25%. In a specific example, if the total surface area of the upper surface 106 equals about 201 $mm^2$, then less than about 5% would be about 10 $mm^2$ or less.

FIG. 2 is a side, cross-sectional view of a PDC 200 that includes a partially leached PCD table 202, according to an embodiment. Except as otherwise disclosed herein, the PDC 200 may be substantially the same as or similar to the PDC 100 shown in FIGS. 1A-1B. For example, the PCD table 202 includes an unleached region 216 that is bonded to a substrate 104, a leached region 218, and an interface 219 therebetween. The leached region 218 extends inwardly from an upper surface 206, at least one lateral surface 212, and optionally a chamfer 214 of the PCD table 202.

FIG. 2 illustrates a predicted initial wear front 220 prior to the PDC 200 being worn. The predicted initial wear front 220 is shown as a surface that extends at an angle θ relative to the at least one lateral surface 212. The angle θ may be about 10° to about 30°, such as about 20°. The predicted initial wear front 220 may intersect the PCD table 202 (e.g., at a bottommost portion of the chamfer 214). During operation, the PCD table 202 may generally wear along an expected wear front 222 that is substantially congruent to the predicted initial wear front 220. Similar to the PCD table 102 (FIG. 1B), a leach boundary-wear intersection location 224 may form when the expected wear front 222 first contacts the unleached region 216. The PCD table 202 may exhibit an $L_1$* value, which is the distance between the predicted initial wear front 220 and the expected wear front 222 when the expected wear front 222 contacts the unleached region 216 (e.g., when the angle θ is about 20°, the shortest distance measured substantially perpendicularly from the predicted initial wear front 220 to a portion of the interface 219). In the illustrated embodiment, the expected wear front 222 contacts the unleached region 216 (where the interface 219 contacts the at least one lateral surface 212). As such, unlike the PCD table 102 (FIG. 1B), increasing the first leach depth $D_1$, the leach depth measured inwardly from the at least one lateral surface 212 and/or the leach depth measured inwardly from the optional chamfer 214 does not increase the $L_1$* value. Instead, the $L_1$* value only increases when the percentage of the at least one lateral surface 212 is leached. Therefore, in some embodiments, the $L_1$* value illustrated in FIG. 2 may be the maximum possible $L_1$* value.

The PCD table 202 may include a plurality of recessed features 208 formed in the upper surface 206. In the illustrated embodiment, the leach boundary-wear intersection location 224 may be spaced relatively far from the upper surface 206. As such, in an embodiment, the plurality of recessed features 208 may exhibit a relatively great depth (e.g., 500 μm or greater), an average depth that is greater than an average width thereof (e.g., by a ratio of about 2 or more), and/or another feature configured to attract cracks to the nearest recessed feature 208 and/or limit spallation.

Figure 3:
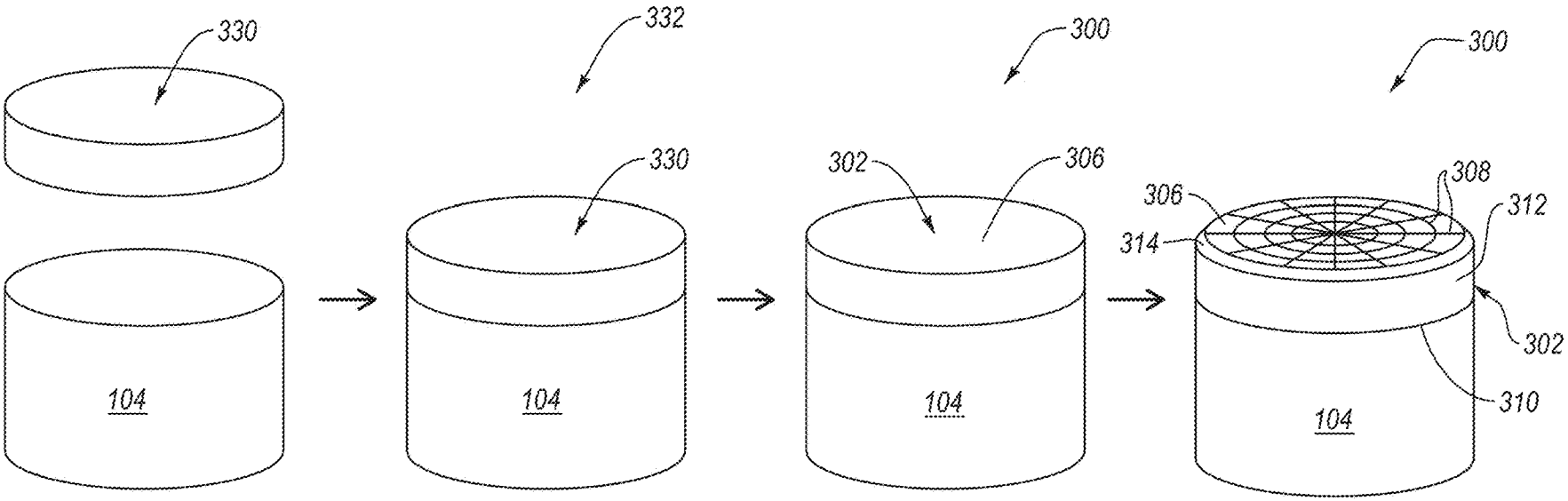
FIG. 3 is a schematic illustration of an embodiment of a method for fabricating a PDC that may be used in any of the embodiments disclosed herein, according to an embodiment.

FIG. 3 is a schematic illustration of an embodiment of a method for fabricating a PDC 300 that may be used in any of the embodiments disclosed herein, according to an embodiment. Referring to FIG. 3, a mass of diamond particles 330 is positioned adjacent to a substrate 104. The mass of diamond particles 330 may exhibit an average particle size of about 0.1 μm to about 150 μm (e.g., about 50 μm or less, about 30 μm or less, about 20 μm or less, about 20 μm to about 18 μm, or about 15 μm to about 18 μm). The diamond particle size distribution of the mass of diamond particles 330 may exhibit a single mode, or may exhibit a bimodal or greater grain size distribution. In an embodiment, the plurality of diamond particles may include a relatively larger size and at least one relatively smaller size. As used herein, the phrases "relatively larger" and "relatively smaller" refer to particles sizes determined by any suitable method, which differ by at least a factor of two (e.g., 40 μm and 20 μm). In various embodiments, the diamond particles 330 may include a portion exhibiting a relatively larger size (e.g., 100 μm, 90 μm, 80 μm 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). Of course, the diamond particles 330 may also include three or more different sizes (e.g., one relatively larger size and two or more relatively smaller sizes), without limitation. Examples of diamond particle size distributions for the diamond particles 300 are disclosed in U.S. Provisional Patent Application No. 61/948,970, U.S. Provisional Patent Application No. 62/002,001, U.S. patent application Ser. No. 13/734,354, and U.S. patent application Ser. No. 14/627,966. The disclosure of each of the foregoing patent applications is incorporated herein, in its entirety, by this reference.

In order to effectively HPHT sinter the mass of diamond particles 330, the mass of diamond particles 330 may be placed adjacent a surface of the substrate 104 to form an assembly 332. The assembly 332 may be placed in a pressure transmitting medium, such as a refractory metal can, graphite structure, pyrophyllite, combinations thereof, or another suitable container or supporting element. The pressure transmitting medium, including the assembly 332, may be subjected to an HPHT process at a temperature of at least about 1000° C. (e.g., about 1100° C. to about 2200° C., or about 1200° C. to about 1450° C.) and a pressure in the pressure transmitting medium of at least about 5 GPa (e.g., at least about 7.5 GPa, at least about 9.0 GPa, at least about 10.0 GPa, at least about 11.0 GPa, at least about 12.0 GPa, at least about 14.0, or about 7.5 GPa to about 9.0 GPa) for a time sufficient to sinter the diamond particles 330 and form a PCD table 302 bonded to the substrate 104 thereby forming the PDC 300.

During the HPHT process, the presence of a catalyst facilitates intergrowth between the mass of diamond particles 330 and forms the PCD table 302 including directly bonded-together diamond grains (e.g., exhibiting $sp^3$ bonding) defining a plurality of interstitial regions. In the illustrated embodiment, the PDC 300 may be formed by sintering the mass of diamond particles 330 on the substrate 104, which may be a cobalt-cemented tungsten carbide substrate. For example, cobalt and/or a cobalt alloy from the substrate 104 liquefies during the HPHT process and infiltrates into the mass of diamond particles 330 to catalyze formation of the PCD table 302. In such an example, some tungsten and/or tungsten carbide (metallic infiltrants) from the substrate 104 may dissolve in or otherwise transfer or alloy with the catalyst. However, in other embodiments, the catalyst may be mixed with the mass of diamond particles 330, provided from a thin foil, another external source, or combinations thereof. Additionally, the catalyst and the metallic infiltrants may react with the mass of diamond particles 330 to form carbides. As such, the interstitial regions of the PCD table 302 may be at least partially occupied by at least one interstitial constituent (e.g., at least one of a metal-solvent catalyst, a metallic infiltrant, one or more formed carbides etc.).

The PCD table 302 so formed may include an interfacial surface 310 bonded to the substrate 104. Examples of interfacial surface geometries for the substrate 104 that may be bonded to the interfacial surface 310 are disclosed in U.S. Pat. No. 8,297,382, the disclosure of which is incorporated herein, in its entirety, by this reference. The PCD table 302 may include an upper surface 306 spaced from the interfacial surface 310 and at least one lateral surface 312 extending between the upper surface 306 and the interfacial surface 310. In an embodiment, the sintered grains of the PCD table 302 may exhibit an average grain size of about 20 μm or less or about 30 μm or less. For example, the average grain size and grain size distribution of the PCD table 302 may be substantially similar or the same as the average diamond particle size and distribution of the mass of diamond particles 330.

Examples of suitable HPHT process conditions that may be used to form any of the PDC embodiments disclosed herein are disclosed in U.S. Pat. No. 7,866,418 which is incorporated herein, in its entirety, by this reference.

After the HPHT process, the PDC 300 may be subsequently shaped to include an optional peripherally-extending chamfer 314. Further, as previously described, the PCD table 302 may be at least partially leached to remove at least a portion of the at least one interstitial constituent therefrom. In an embodiment, the PDC 300 may be at least partially immersed in and/or exposed to a leaching agent (e.g., hydrofluoric acid, nitric acid, a supercritical fluid, a gaseous leaching agent, another suitable leaching agent, or combinations thereof) to at least partially remove at least one interstitial constituent from the PCD table 302 to form a leached region (e.g., leach regions 118, 218 of FIGS. 1B-2). Removing at least a portion of the at least one interstitial constituent from the PCD table 302 may improve the wear resistance, heat resistance, thermal stability, or combinations thereof of the PCD table 302, particularly in situations where the PCD table 302 may be exposed to elevated temperatures.

In an embodiment, the PCD table 302 may include a plurality of recessed features 308 formed in the upper surface 306 thereof after the PCD table 302 is at least partially leached. For example, the plurality of recessed features 308 may be formed in the upper surface 306 by grinding or machining, such as at least one of laser machining, electrical discharge machining, or water jet machining. Examples of methods of using a laser to cut or machine a PCD table are disclosed in U.S. Pat. No. 9,062,505, the disclosure of which is incorporated herein, in its entirety, by this reference. In another example, the plurality of recessed features 308 may be formed in the upper surface 306 using acid etching, plasma etching, or other suitable etching techniques. Forming the plurality of recessed features 308 after leaching the PCD table 302 may result in a leached region that exhibits a first leach depth $D_1$ and a second leach depth $D_2$ that is less than the first leach depth $D_1$ (FIG. 1B).

In another embodiment, the PCD table 302 may have the plurality of recessed features 308 formed in the upper surface 306 prior to leaching the PCD table 302. In such an embodiment, the plurality of recessed features 308 may be formed using any of the methods disclosed above. Additionally, the plurality of recessed features 308 may be formed using electrical discharge machining (e.g., wire electrical discharge machining) or pressed into the diamond particles before and/or during the HPHT process. The PCD table 302 including the plurality of recessed features 308 formed therein may then be leached using any of the leaching techniques disclosed herein. Forming the plurality of recessed features 308 prior to leaching the PCD table 302 may result in a leached region that exhibits a substantially uniform leach depth extending inwardly from the upper surface 306 and a base of each of the plurality of recessed features 308. For example, the leached region may be generally complementary to the topography of the outer surface of the top/upper surface of the PCD table 302 including surfaces formed by the recessed features 308.

In an embodiment, the plurality of recessed features 308 are formed in the upper surface 306 after leaching. For example, the plurality of recessed features 308 formed after leaching may be closer to a leach boundary-wear intersection location than if recessed features 308 were formed prior to leaching. As such, the plurality of recessed features 308 formed after leaching may exhibit a smaller average depth than the plurality of recessed features 308 formed prior to leaching.

Figure 4A:
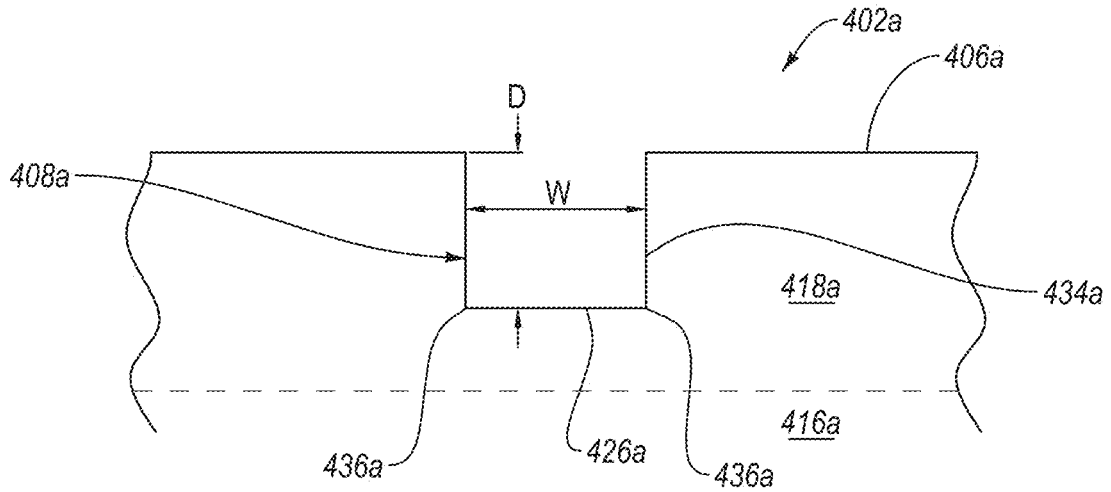
FIGS. 4A-4C are partial, side, cross-sectional views of PCD tables that include at least one recessed feature formed therein that each exhibit different cross-sectional geometries, according to different embodiments.
Figure 4B:
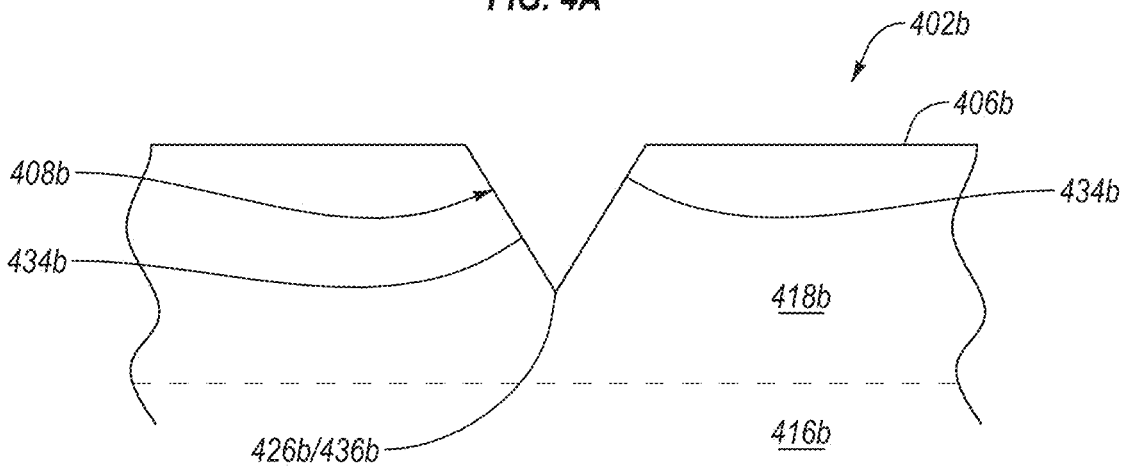
Figure 4C:
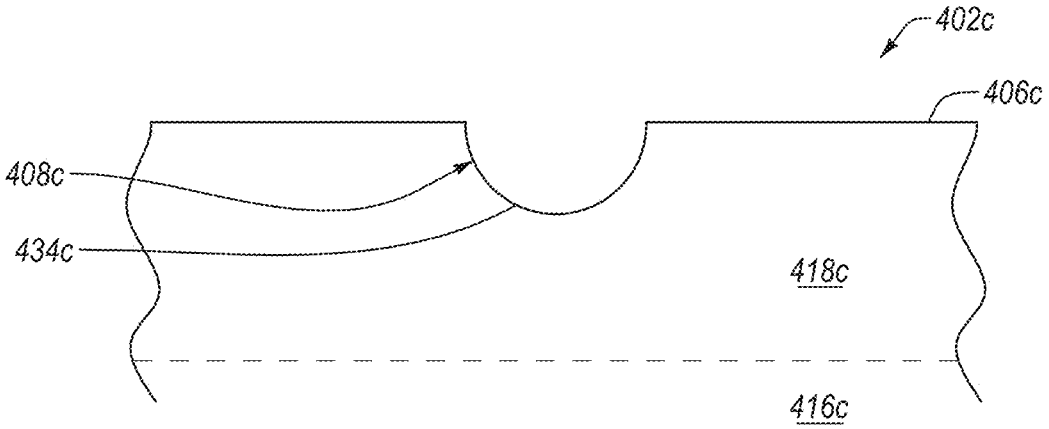

Any of the recessed features disclosed herein may exhibit a number of suitable side, cross-sectional geometries. For example, any of the PCD tables disclosed herein may include a first plurality of recessed features that exhibits a first cross-sectional geometry (in side view) and a second plurality of recessed features that exhibits a second cross-sectional geometry (in side view) that is different than the first cross-sectional geometry. In another example, any of the PCD table disclosed herein may include a plurality of recessed features that each exhibits a substantially similar cross-sectional geometry. FIGS. 4A-4C are partial, side, cross-sectional of PCD tables that include at least one recessed feature formed therein that each exhibit different cross-sectional geometries, according to different embodiments. The PCD tables illustrated in FIGS. 4A-4C may be substantially the same as or similar to the PCD tables 102, 202, 302 (FIGS. 1A-3). Similarly, the cross-sectional geometries (in side view) of the recessed features illustrated in FIGS. 4A-4C may be used in any of the embodiments disclosed herein.

Referring to FIG. 4A, a PCD table 402*a* includes a leached region 418*a* and an unleached region 416*a*. The leached region 418*a* extends inwardly from an upper surface 406*a* of the PCD table 402*a*. The PCD table 402*a* also includes at least one recessed feature 408*a* formed in and extending inwardly from the upper surface 406*a*.

In the illustrated embodiment, the at least one recessed feature 408*a* exhibits a generally rectangular cross-sectional geometry (in side view). The generally rectangular cross-sectional geometry of the at least one recessed feature 408*a* may include a base 426*a* having a length and at least two side surfaces 434*a* extending from the base 426*a* to the upper surface 406*a*. The at least two side surfaces 434*a* may be substantially parallel, slightly diverge, or slightly converge relative to each other. In an embodiment, the at least two side surfaces 434*a* may also extend substantially perpendicularly or at an oblique angle relative to the upper surface 406*a* and/or the base 426*a*.

The generally rectangular cross-sectional geometry of the at least one recessed feature 408*a* may also include at least two corners 436*a* where the at least two side surfaces 434*a* meet the base 426*a*. The corners 436*a* may exhibit a radius of curvature, a fillet, or any other geometry. For example, at least one of the corners 436*a* may exhibit a relatively small radius of curvature when the corner 436*a* is sharp or exhibit a relatively large radius of curvature when the corner 436*a* is rounded. The radius of curvature of the corners 436*a* may correspond to a stress concentration factor exhibited by the corners. For example, a corner 436*a* that is sharp is expected to exhibit a relatively larger stress concentration factor than a corner 436*a* that is rounded. As such, a corner 436*a* may exhibit a sharp corner when the at least one recessed feature 408*a* is spaced relatively far from a leach boundary-wear intersection location. In an embodiment, the at least one recessed feature 408*a* may include a first corner that is relatively sharp and a second corner that is relatively round. In another embodiment, the at least one recessed feature 408*a* may only exhibit a relatively sharp corner along a selected length of the at least one recessed feature 408*a*.

Referring to FIG. 4B, a PCD table 402*b* includes a leached region 418*b* and an unleached region 416*b*. The leached region 418*b* extends inwardly from an upper surface 406*b* of the PCD table 402*b*. The PCD table 402*b* also includes at least one recessed feature 408*b* formed in and extending inwardly from the upper surface 406*b*.

The at least one recessed feature 408*b* exhibits a cross-sectional geometry (in side view) that is generally v-shaped. The generally v-shaped cross-sectional geometry may include at least two side walls 434*b* that extend and diverge from a base 426*b* to the upper surface 406*b*. At least one of the two side walls 434*b* may exhibit an oblique angle relative to the upper surface 406*b*. In the illustrated embodiment, the base 426*b* of the at least one recessed feature 408*b* exhibits a corner 436*b*. Similar to the at least two corners 436*a* (FIG. 4A), the corner 436*b* may be sharp or rounded. For example, the corner 436*b* may be sharp if the corner 436*b* is relatively spaced from a leach boundary-wear intersection location.

Referring to FIG. 4C, the PCD table 402*c* includes a leached region 418*c* and an unleached region 416*c*. The leached region 418*c* extends inwardly from an upper surface 406*c* of the PCD table 402*c*. The PCD table 402*c* also includes at least one recessed feature 408*c* formed in and extending inwardly from the upper surface 406*c*.

The at least one recessed feature 408*c* exhibits a cross-sectional geometry (in side view) that is arcuate (e.g., generally partially elliptical, such as partially circular). As such, the at least one recessed feature 408*c* may include a single continuous wall 434*c* that exhibits a generally concave shape relative to the upper surface 406*c*. Since the at least one recessed feature 408*c* does not include any corners, the at least one recessed feature 408*c* may exhibits a relatively low stress concentration factor. However, cracks formed in the PCD table 402*c* may be preferentially attracted to the at least one recessed feature 408*c* at least partially due to a proximity of the at least one recessed feature 408*c* to the crack.

Any of the recessed features disclosed herein (e.g., grooves, recesses, notches, dimples, channels, or networks) may exhibit any suitable pattern or network when formed in an upper surface of a PCD table. FIGS. 5-10E are top plan views of different PCD tables that exhibit different patterns of the plurality of recessed features formed in an upper surface thereof, according to different embodiments. The PCD tables illustrated in FIGS. 5-10E may be substantially the same as or similar to the PCD tables 102, 202, 302, 402*a-c* (FIGS. 1-4C). For example, the PCD tables may be a partially leached PCD table that is bonded to a substrate. Any of the patterns illustrated in FIGS. 5-10E may be used in any of the embodiments disclosed herein. Additionally, any one or more of the patterns illustrated in FIGS. 5-10E or portions thereof may be combined together, without limitation.

Figure 5:
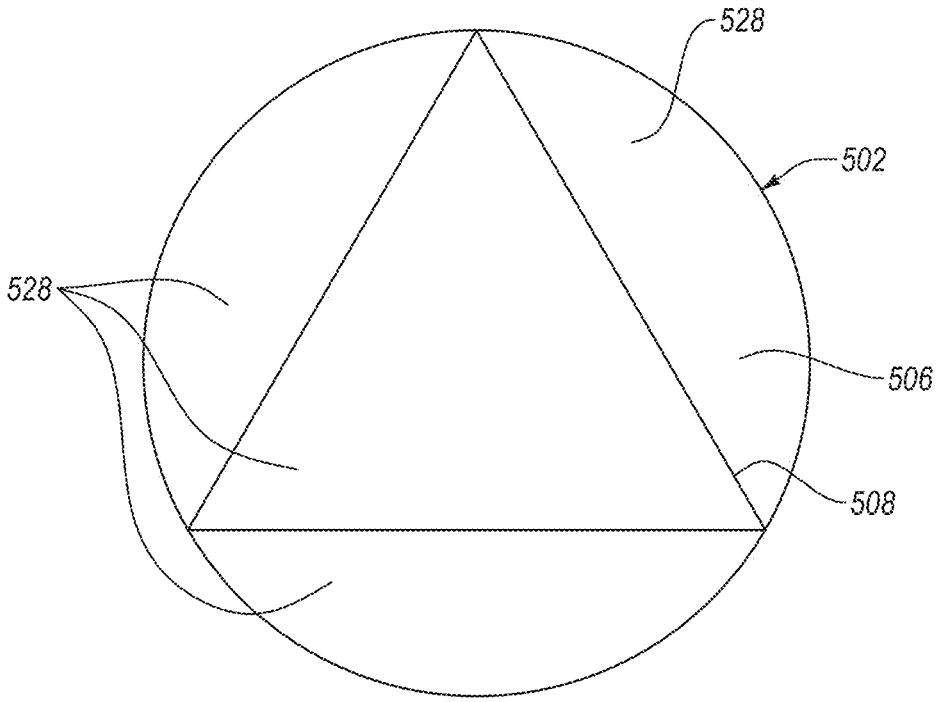
FIGS. 5-10E are top plan views of PCD tables that exhibit different patterns of a plurality of recessed features formed in an upper surface thereof, according to different embodiments.

Referring to FIG. 5, a PCD table 502 includes a plurality of recessed features 508 formed in an upper surface 506 thereof. The plurality of recessed features 508 form a generally triangular shape that is centered about a location on the upper surface 506 (e.g., a center of the upper surface 506). However, the plurality of recessed features 508 may form any other suitable shape, such as a generally circular shape, a generally rectangular shape, a generally pentagonal shape, a generally hexagonal shape, a generally elliptical shape, a generally crescent shape, or any other suitable shape. In the illustrated embodiment, the plurality of recessed features 508 only form a plane figure shape. However, the plurality of recessed features 508 may form a plurality of shapes that are each oriented differently (e.g., rotated, centered about a different location), exhibit different sizes, exhibit different shapes, intersect each other, or combinations thereof.

In the illustrated embodiment, the plurality of recessed features 508 extend from and contact an outer edge of the upper surface 506. As such, the plurality of recessed features 508 form four cells 528. Three of the cells 528 are formed along the outer edge of the upper surface 506 and form three distinct cutting surfaces. The plurality of recessed features 508 may limit spalling of one of the cells 528 from significantly adversely affecting the other cells 528. Additionally, the four cells 528 may limit spalling in a radial direction more than in a circumferential direction. Other patterns may form more or less cells and increase or decrease the amount of spalling in a radial and/or circumferential direction.

Figure 6:
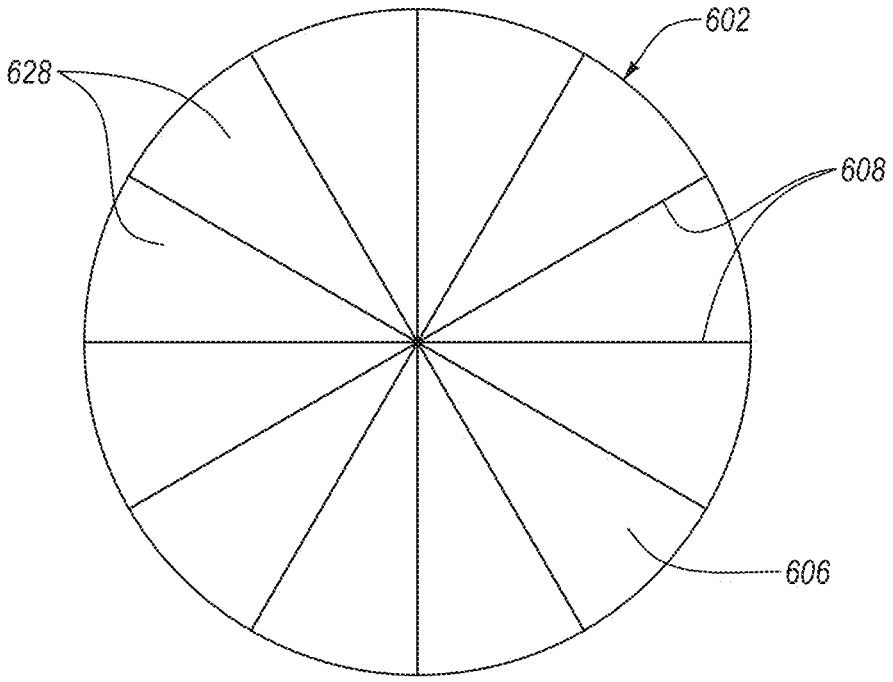

Referring to FIG. 6, a PCD table 602 includes a plurality of recessed features 608 formed in an upper surface 606 thereof. The plurality of recessed features 608 may extend radially from and/or relative to a location on the upper surface 606 (e.g., a center of the upper surface 606) to form a generally spoke-like pattern. As such, the plurality of recessed features 608 may form a plurality of cells 628 that may limit spalling along a circumferential direction. In an embodiment, the plurality of recessed features 608 may be substantially straight, curved, exhibit an "S" shape, or any other suitable shape. In an embodiment, each of the plurality of recessed features 608 may be angularly equidistantly spaced from each other. In another embodiment, at least some of the plurality of recessed features 608 may not be angularly equidistantly spaced from each other. In an embodiment, an angular spacing between two adjacent recessed features 608 may be equal to or greater than an angular spacing of an expected wear front in the PCD table 602 when the PCD table 602 is expected to spall.

Figure 7A:
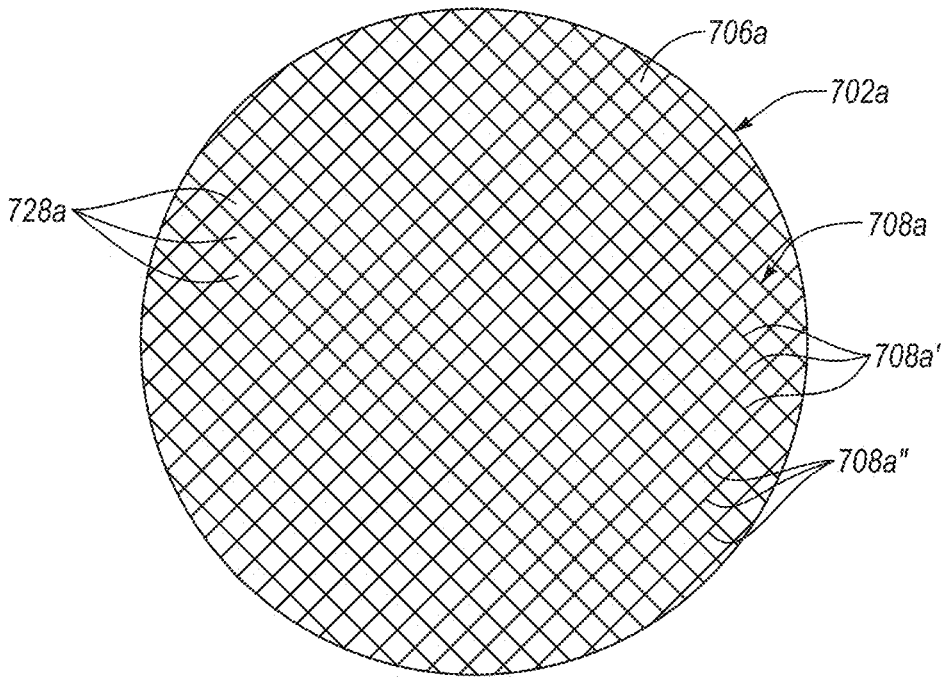

FIGS. 7A-7D illustrate different embodiments in which a plurality of recessed features form different grid-like patterns in a PCD table. The grid-like patterns illustrated in FIGS. 7A-7D may substantially equally limit spalling of the PCD table in a circumferential and radial direction. Referring to FIG. 7A, a PCD table 702*a* may include a plurality of recessed features 708*a* formed in an upper surface 706*a* thereof. The plurality of recessed features 708*a* includes a plurality of first recessed features 708*a*' that extend substantially parallel to each other and a plurality of second recessed features 708*a*" that extend substantially parallel to each other and substantially orthogonally relative to the plurality of first recessed features 708*a*'. As such, the plurality of recessed features 708*a* form a plurality of generally rectangular cells 728*a* that form a generally rectangular grid-like pattern. However, in an embodiment, the plurality of first and second recessed features 708*a*', 708*a*" extend obliquely relative to each other.

Figure 7B:
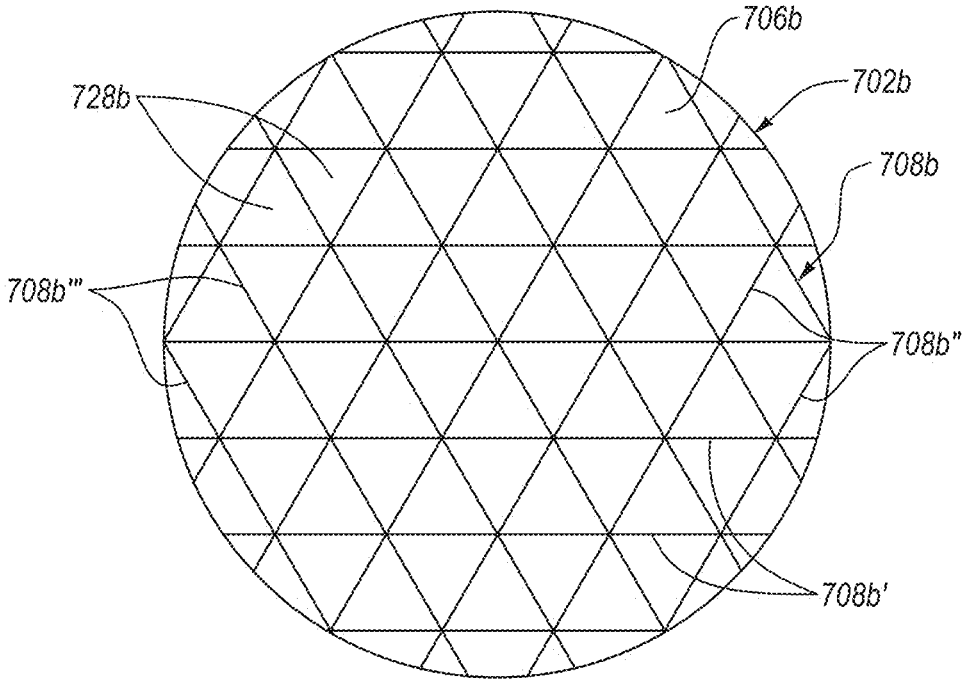

Referring to FIG. 7B, a PCD table 702*b* may include a plurality of recessed features 708*b* formed in an upper surface 706*b* thereof. The plurality of recessed features 708*b* includes plurality of first recessed features 708*b*' that extend substantially parallel to each other, a plurality of second recessed features 708*b*" that extend substantially parallel to each other, and a plurality of third recessed features 708*b*'" that extend substantially parallel to each other. In an embodiment, each of the plurality of first, second, and third recessed features 708*b*', 708*b*", 708*b*'" may extend obliquely relative to each other. In another embodiment, two of the plurality of first, second, or third recessed features 708*b*', 708*b*", 708*b*'" may extend substantially orthogonally relative to each other. In an embodiment, the plurality of recessed features 708*b* may form a plurality of generally triangular cells 728*b* that form a generally triangular grid-like pattern.

Figure 7C:
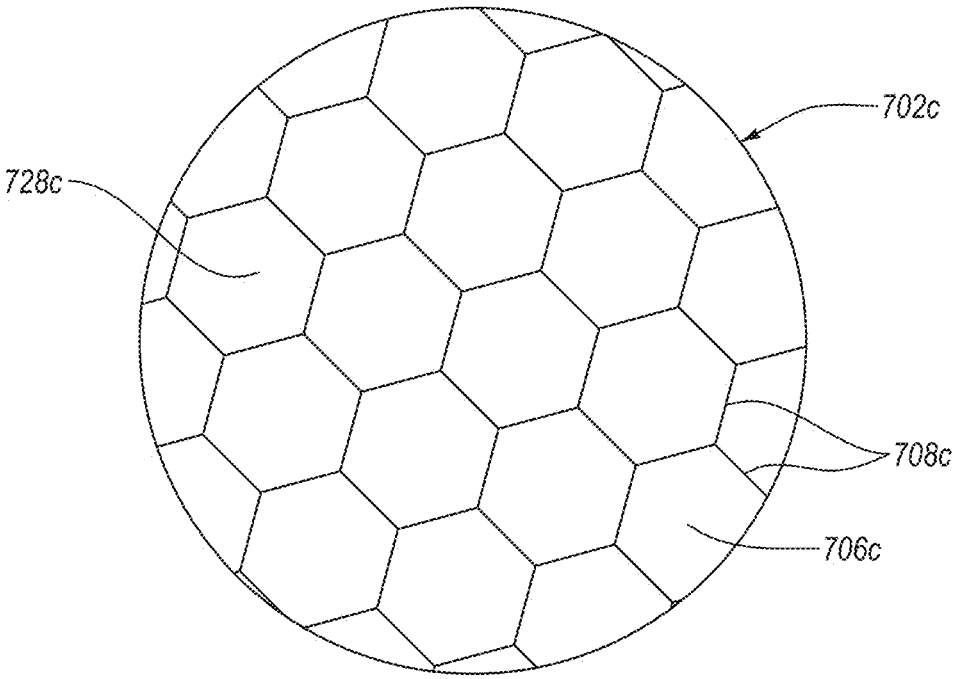

Referring to FIG. 7C, a PCD table 702*c* may include a plurality of recessed features 708*c* formed in an upper surface 706*c* thereof. The plurality of recessed features 708*c* form a plurality of generally hexagonal cells 728*c* that form a grid-like pattern.

Figure 7D:
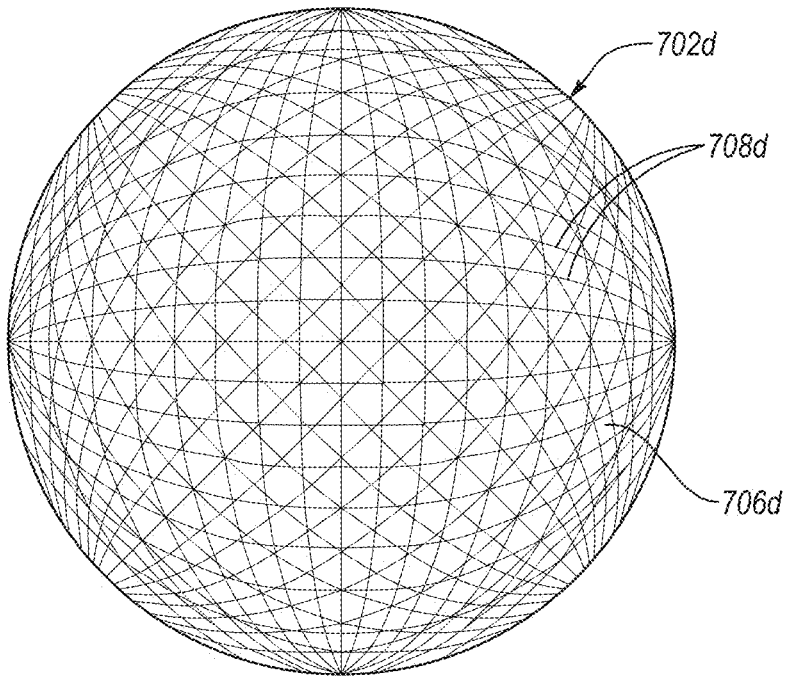

Referring to FIG. 7D, a PCD table 702*d* may include a plurality of recessed features 708*d* formed in an upper surface 706*d* thereof. At least some of the plurality of recessed features 708*d* may be curved. In the illustrated embodiment, each of the plurality of recessed features 708*d* extend from at least two locations (e.g., eight locations) positioned at or near an outer edge of the upper surface 706*d*. The plurality of recessed features 708*d* may extend between generally opposite locations in substantially the same manner as longitudinal lines on an equatorial Robinson projection, an equatorial Winkel tripel projection, an equatorial azimuthal equidistant projection, an equatorial stereographic projection, an equal-area Mollweide projection, etc. As such, a concentration of the plurality of recessed features 708*d* may be greatest at or near the at least two locations. Additionally, the concentration of the plurality of recessed features 708*d* may be greater at and near the edge of the upper surface 706*d* than at a center of the upper surface 706*d*.

Figure 8A:
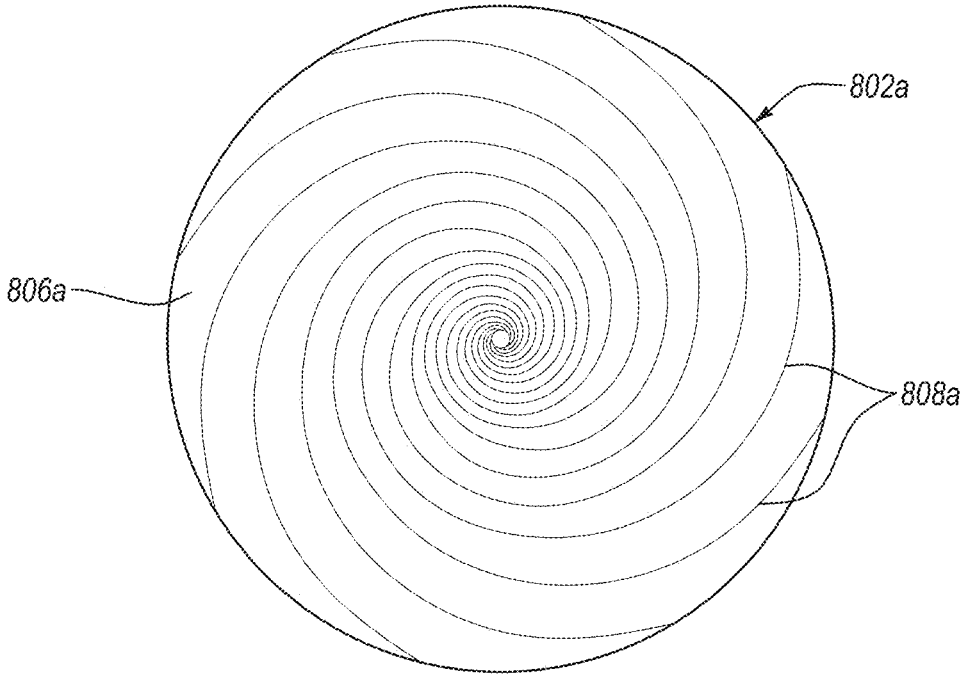
Figure 8B:
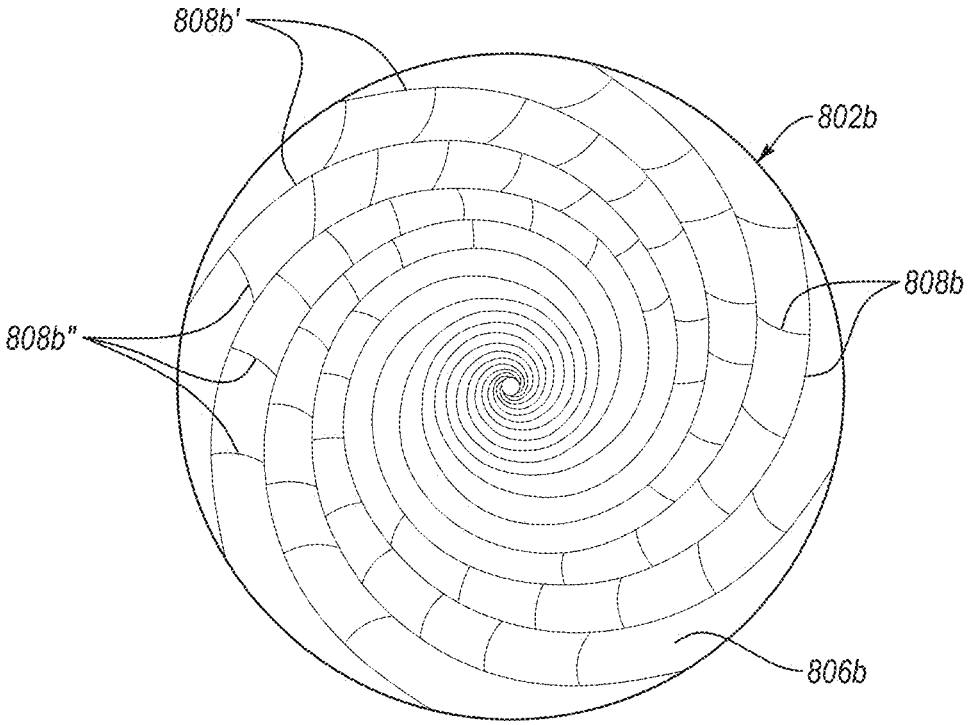
Figure 8C:
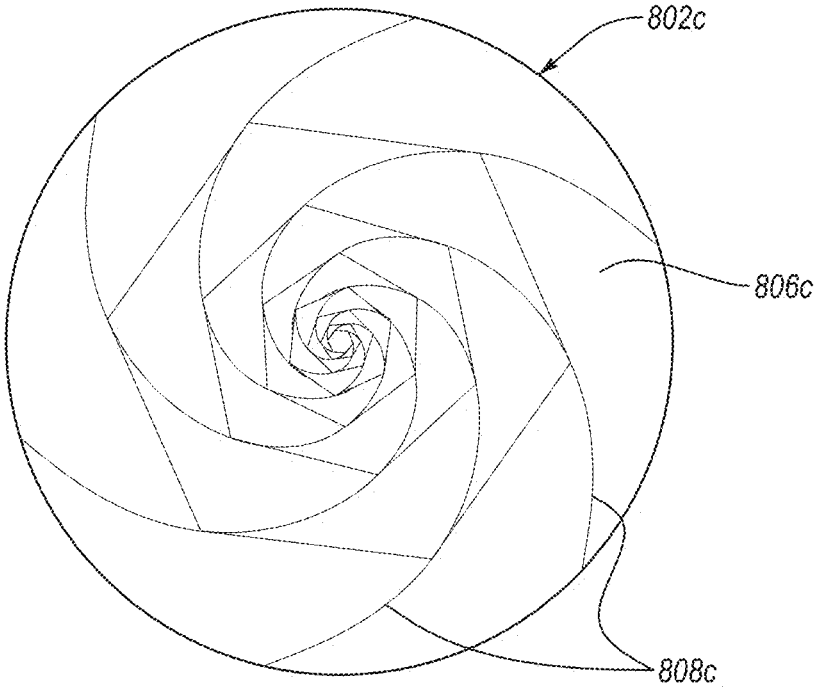
Figure 8D:
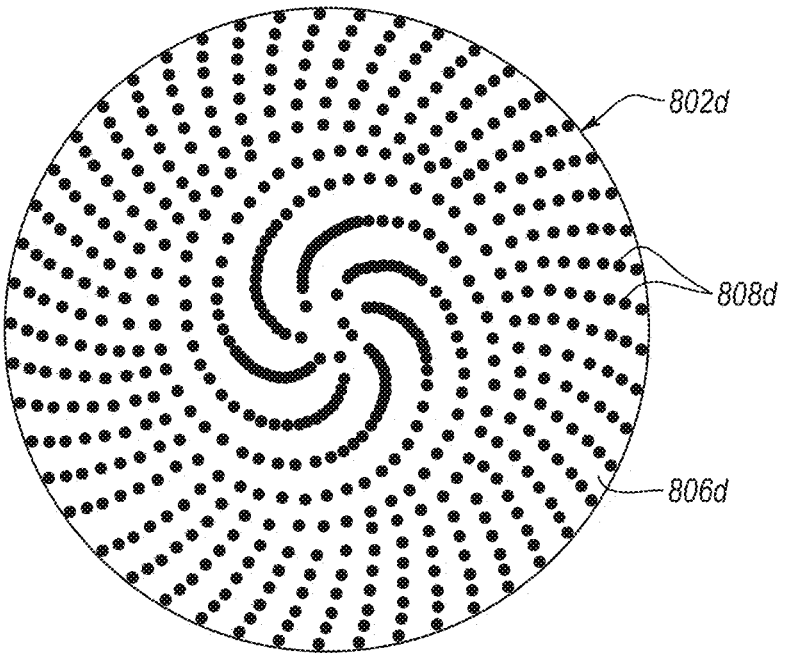
Figure 8E:
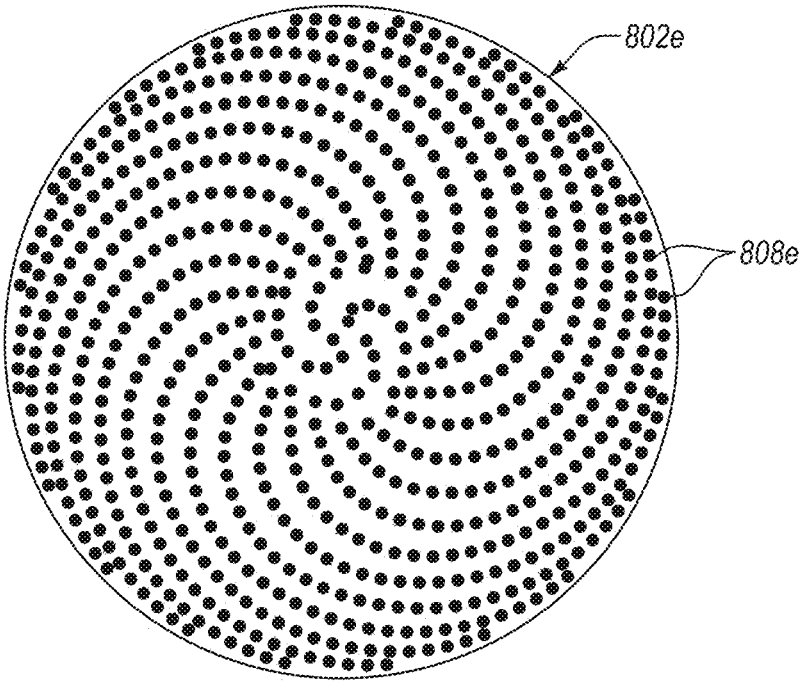
Figure 8F:
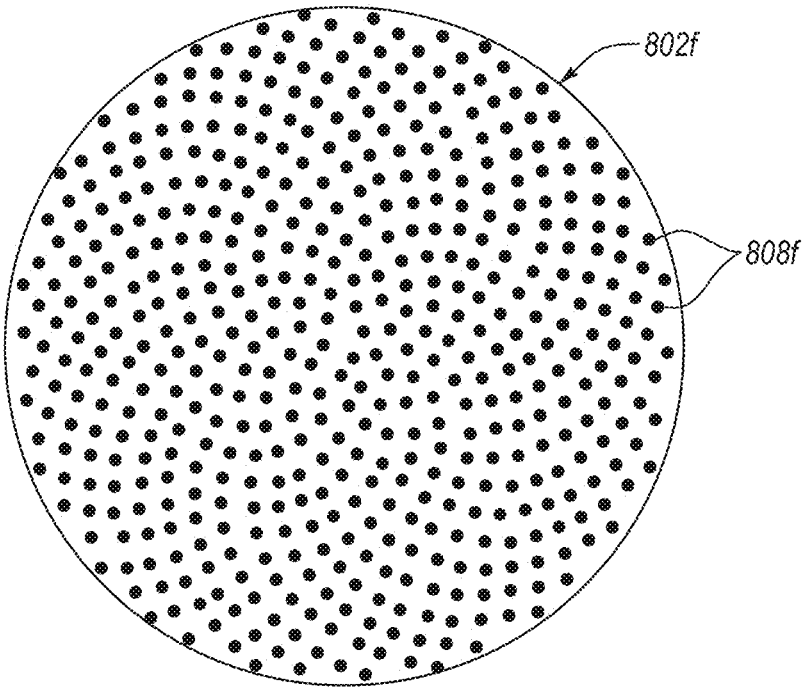
Figure 8G:
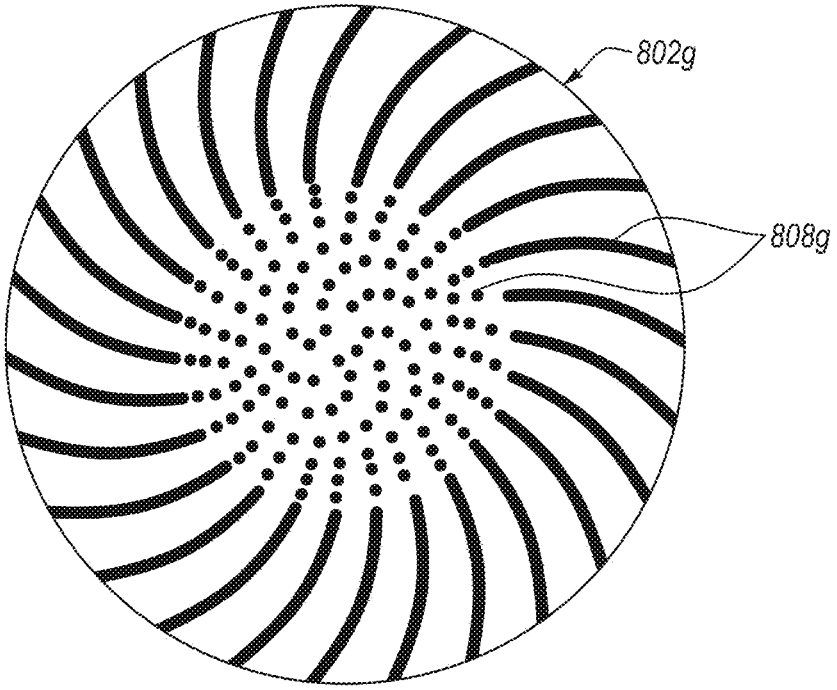
Figure 8H:
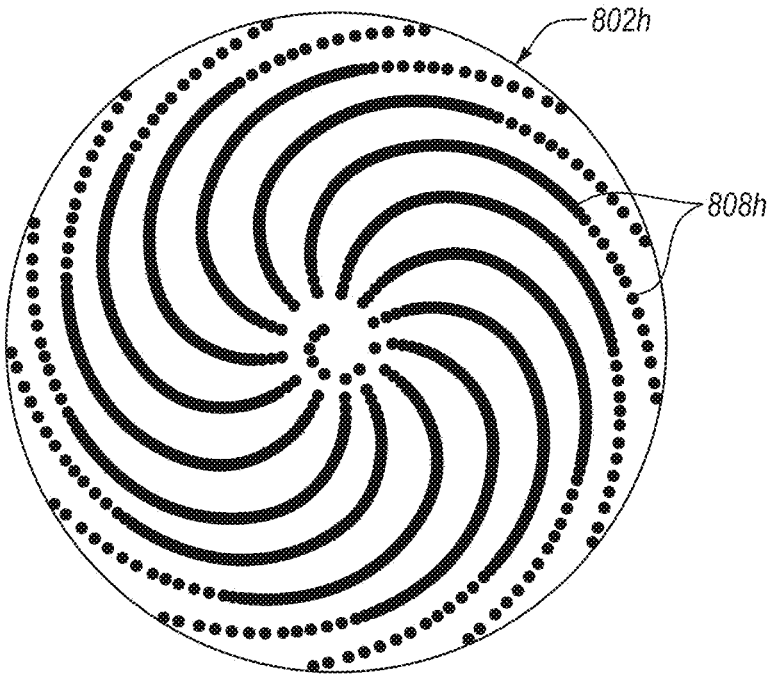
Figure 8I:
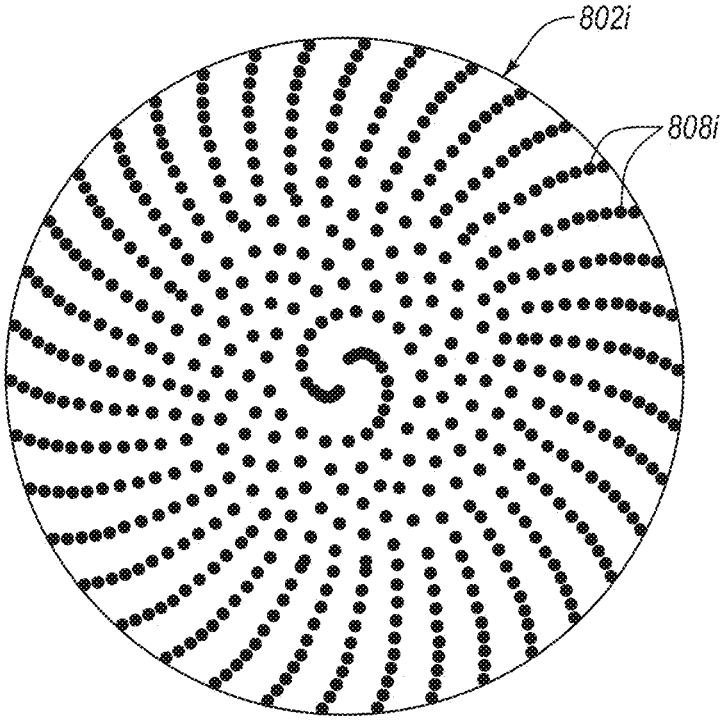

FIGS. 8A-8C illustrate different embodiments in which a plurality of recessed features form a generally two-dimensional or three-dimensional spiral pattern. The generally spiral pattern of the plurality of recessed features may limit spalling of the PCD table in a circumferential and radial direction. Referring to FIG. 8A, a PCD table 802*a* may include a plurality of recessed features 808*a* formed in an upper surface 806*a* thereof. The plurality of recessed features 808*a* may extend in a spiral from and/or relative to a location or area on the upper surface 806*a* (e.g., a center of the upper surface 806*a*). In an embodiment, each of the plurality of recessed features 808*a* may be equidistantly spaced from each other. In another embodiment, at least some of the plurality of recessed features 808*a* may not be equidistantly spaced from each other. In an embodiment, a circumferential spacing between two adjacent recessed features 808*a* may be equal to or greater than a circumferential width of an expected wear front in the PCD table 802*a* when the PCD table 802*a* is expected to spall.

Referring to FIG. 8B, a PCD table 802*b* may include a plurality of recessed features 808*b* formed in an upper surface 806*b* thereof. The plurality of recessed features 808*b* may include a plurality of first recessed features 808*b*' and a plurality of second recessed features 808*b*". The plurality of first recessed features 808*b*' may be substantially the same as or similar to the plurality of recessed features 808*a* (FIG. 8A). For example, the plurality of first recessed features 808*b*' may extend along a spiral from a location or area on the upper surface 806*b*. The plurality of second recessed features 808*b*" may extend between at least some of the plurality of first recessed features 808*b*' (e.g., generally crosswise or transverse to the first recessed features 808*b*'). As such, the plurality of second recessed features 808*b*" may further limit the spalling in a circumferential and radial direction compared to the plurality of recessed features 808*a* (FIG. 8A).

Referring to FIG. 8C, a PCD table 802*c* may include a plurality of recessed features 808*c* formed in an upper surface 806*c* thereof. The plurality of recessed features 808*c* may extend along a spiral from a location or area on the upper surface 806*c* (e.g., a center of the upper surface 806*c*). However, the plurality of recessed features 808*c* may be relatively angular and/or discontinuous. The plurality of recessed features 808*c* may also include a plurality of recessed features that extend between the plurality of recessed features 808*c*.

FIGS. 8D-8I illustrate different PCD tables 802*d-i* that include a plurality of recessed features 808*d-i* formed in an upper surface 806*d-i* thereof. The plurality of recessed features 808*d-i* shown in FIGS. 8D-8I are embodiments of different spiral patterns that the plurality of recessed features 808*d-i* may form. Additionally, each of the plurality of recessed features 808*d-i* may be discontinuous recessed features (e.g., formed from a plurality of notches, dimples, recesses, or divots). In an embodiment, at least some of the plurality of recessed features 808*d-i* may be formed sufficiently close together that the at least some of the plurality of recessed features 808*d-i* forms a continuous feature (e.g., the plurality of recessed features 800*d*, 808*g-i* of FIGS. 8D, 8G-8I). In another embodiment, the plurality of notches may be uniformly distributed across the upper surface (e.g., the plurality of recessed features 808*f* of FIG. 8F). It is noted that any of the recessed features disclosed herein may be formed from a plurality of notches, dimples, recesses, or divots. It is also noted that any of the spiral patterns shown in FIGS. 8D-8I may be at least partially formed (e.g., completely formed) from a continuous channel instead of the plurality of notches, dimples, recesses, or divots. In some embodiments, a plurality of recessed features may include at least one substantially continuous recessed feature (e.g., at least one groove, at least one channel, etc.) and at least one discrete recessed feature (e.g., at least one notch, dimple, recess, or divot).

Figure 9A:
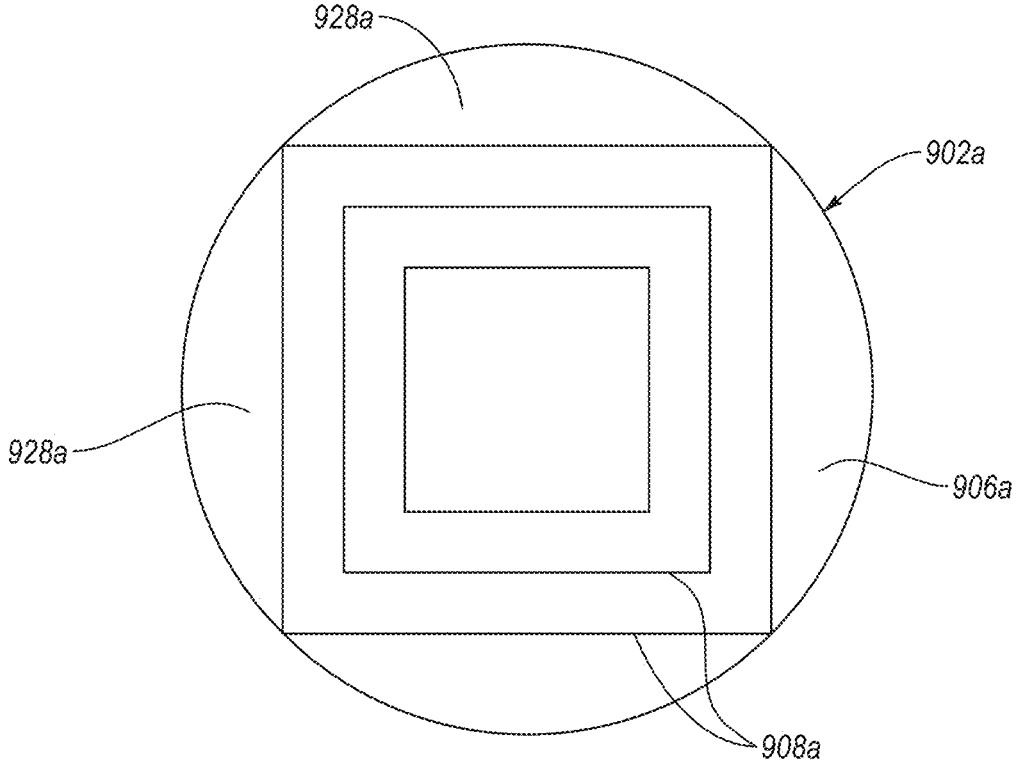

FIGS. 9A-9D illustrate different embodiments in which a plurality of recessed features form a plurality of generally concentric shapes that may limit spalling in at least a radial direction. Referring to FIG. 9A, a PCD table 902*a* may include a plurality of recessed features 908*a* formed in an upper surface 906*a* thereof. The plurality of recessed features 908*a* may form a plurality of generally rectangular shapes that are generally concentric relative to a location on the upper surface 906*a* such as a center of the upper surface 906*a*. The generally rectangular shapes formed by the plurality of recessed features 908*a* may form a plurality of cells 928*a*, four of which are adjacent to an outer edge of the upper surface 906*a*. The four cells 928*a* may partially define four distinct cutting surfaces that may each spall without substantially adversely affecting the others. In operation, the outermost generally rectangular shape may be configured to limit spalling in a direction generally radially inwardly. However, the other generally rectangular shapes spaced inwardly from the outermost generally rectangular shape may be configured to further limit spalling in a general radial direction if the spalling extends past the outermost generally rectangular shape.

The plurality of recessed features 908*a* may form any suitable shapes (e.g., generally geometrically expanding or contracting shapes centered about a common point). For example, the plurality of recessed features 908*a* may form a generally circular shape, a generally rectangular shape, a generally pentagonal shape, a generally hexagonal shape, a generally elliptical shape, a generally crescent shape, or any other suitable shape. In an embodiment, the plurality of recessed features 908*a* may form a plurality of different shapes that are generally centered about a common point relative to each other. For example, the plurality of recessed features 908*a* may form an outermost shape that is generally rectangular and another shape that is inwardly generally centered relative to the outermost shape that is generally triangular. In an embodiment, at least one of the generally rectangular shapes may be rotated relative to the outermost generally rectangular shape.

Figure 9B:
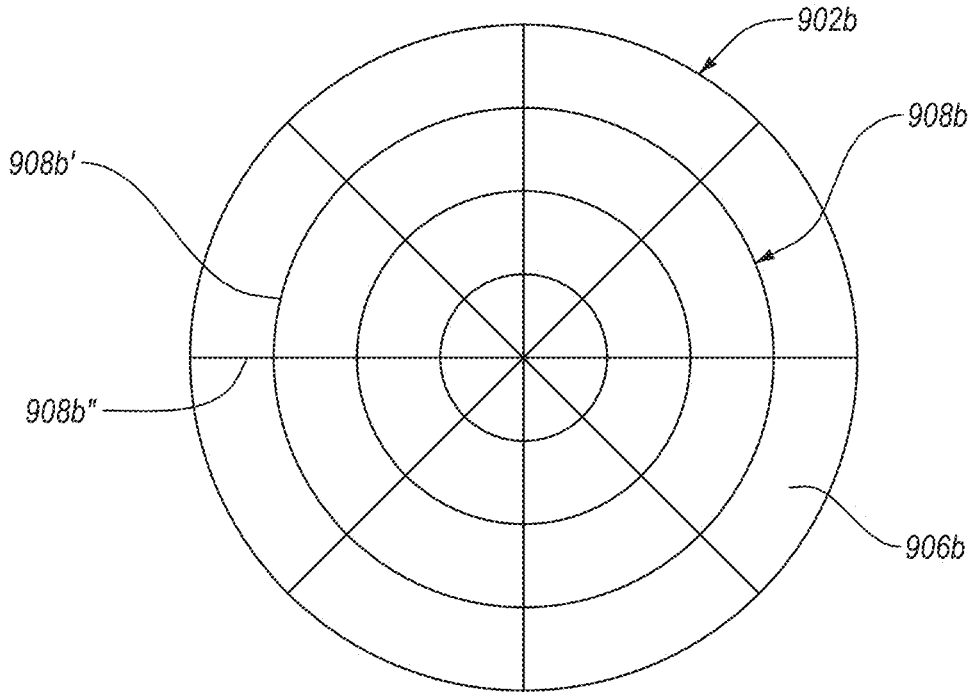

Referring to FIG. 9B, a PCD table 902*b* includes a plurality of recessed features 908*b* formed in an upper surface 906*b* thereof. The plurality of recessed features 908*b* may include a plurality of first recessed features 908*b*' and a plurality of second recessed features 908*b*". The plurality of first recessed features 908*b*' may form a plurality of shapes centered about a common point, such as a plurality of concentric generally circular shapes. The plurality of first recessed features 908*b*' may be generally concentric relative to a location on the upper surface 906*b* (e.g., a center of the upper surface 906*b*). The plurality of second recessed features 908*b*" may be substantially the same as or similar to the plurality of recessed features 608 (FIG. 6). For example, the plurality of second recessed features 908*b*" may extend from the same common point on the upper surface 906*b* that the plurality of first recessed features 908*b*' are centered about or extend from another location on the upper surface 906*b*.

The plurality of recessed features 908*b* illustrate an example of combining two of the patterns disclosed herein to form a single pattern. As such, the plurality of recessed features 908*b* may exhibit the benefits of the pattern discussed in FIG. 6 and the generally concentric shapes discussed in FIG. 9A. For example, the plurality of first recessed features 908*b*' may limit spalling in a radial direction while the plurality of second recessed features 908*b*" may limit spalling in a circumferential direction.

In an embodiment, the plurality of first recessed features 908*b*' may not include a plurality of generally commonly centered shapes. Instead, the plurality of first recessed features 908*b*' may include a plurality of linear, convexly curved, and/or concavely recessed features that extend between the plurality of second recessed features 908*b*" in any suitable manner. For example, the plurality of first recessed features 908*b*' may form a plurality of shapes that are not generally centered with respect to each other. In another example, at least some of the plurality of first recessed features 908*b*' may be radially offset from a circumferentially adjacent first recessed feature 908*b*' (e.g., at least some of the plurality of first recessed features 908*b*' may not form continuous shapes).

Figure 9C:
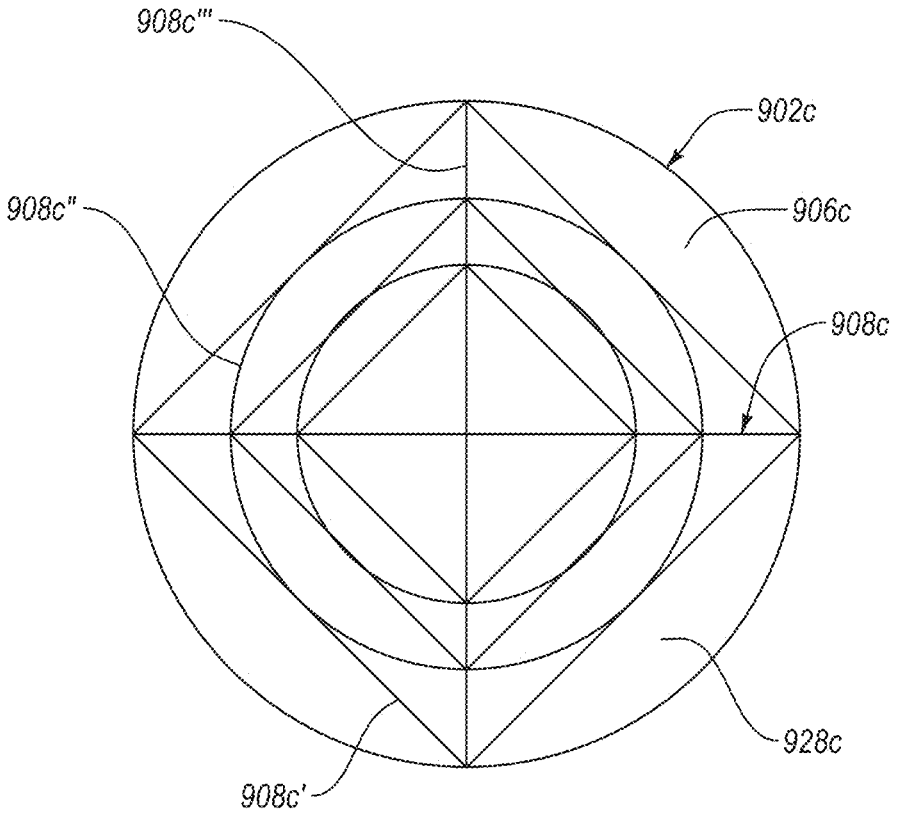

Referring to FIG. 9C, a PCD table 902*c* includes a plurality of recessed features 908*c* formed in an upper surface 906*c* thereof. The plurality of recessed features 908*c* include a plurality of first recessed features 908*c*', a plurality of second recessed features 908*c*", and a plurality of third recessed features 908*c*'". The plurality of first recessed features 908*c*' may be substantially similar to the plurality of recessed features 908*a* (FIG. 9A). For example, the plurality of first recessed features 908*c*' may include a plurality of generally commonly centered shapes, such as a plurality of concentric generally rectangular shapes. The outermost concentric generally rectangular shape may define four cells 928*c* adjacent to an outer edge of the upper surface 906*c*. The plurality of second recessed features 908*c*" may include a plurality of generally concentric shapes that are different than the plurality of first recessed features 908*c*'. For example, the plurality of second recessed features 908*c*" may be a plurality of concentric generally circular shapes. The plurality of second recessed features 908*c*" may be positioned between the shapes formed by the plurality of first recessed features 908*c*'. Finally, the plurality of third recessed features 908*c*'" form a plurality of radially-extending recessed features (e.g., a generally spoke-like pattern) that extend from a common location on the upper surface 906*c*.

The plurality of recessed features 908*c*'-908*c*'" illustrate an example of combining three patterns to form a single network or pattern. For example, the plurality of first recessed features 908*c*' may limit spalling in a generally radial direction and the plurality of third recessed features 908*c*'" may limit spalling in a generally circumferential direction. The plurality of first, second, and third recessed features 908*c*', 908*c*", 908*c*'" may form further spall-limiting features.

Figure 9D:
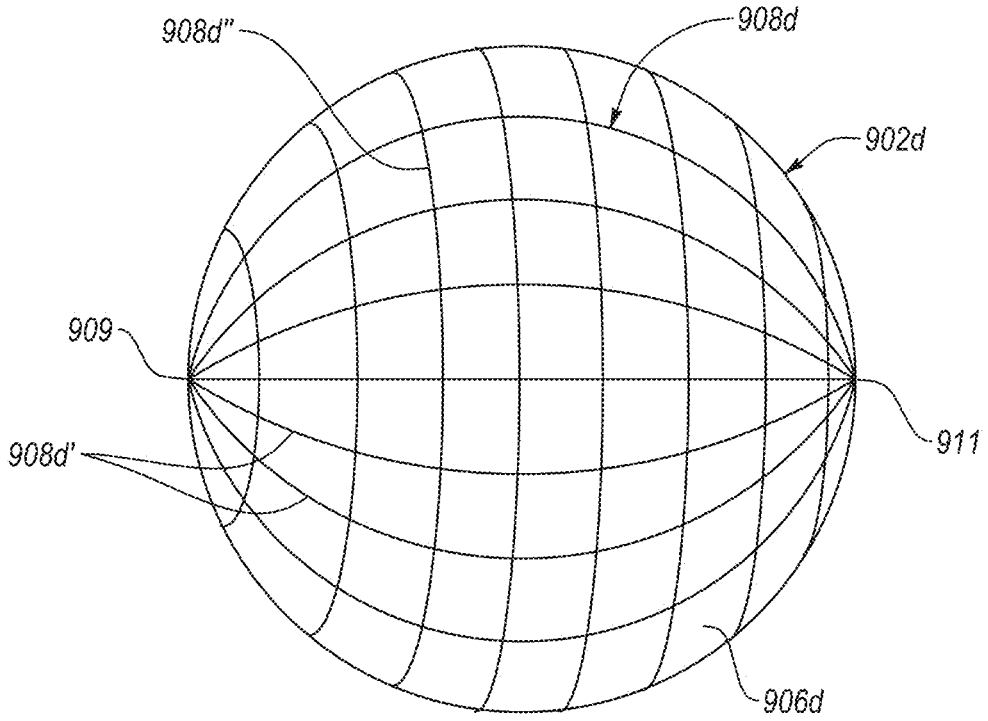

Referring to FIG. 9D, a PCD table 902*d* includes a plurality of recessed features 908*d* formed in an upper surface 906*d* thereof. The plurality of recessed features 908*d* may include a plurality of first recessed features 908*d*' and a plurality of second recessed features 908*d*". The plurality of first recessed features 908*d*' may be substantially similar to the plurality of recessed features 708*d* (FIG. 7D). For example, the plurality of first recessed features 908*d*' may include a plurality of curved recessed features extending between two locations (e.g., end locations 909 and 911). The plurality of second recessed features 908*d*" may form a plurality of generally concentric shapes, such as a plurality of generally concentric arcs that are generally centered about a common location (e.g., end locations 909, 911, a location on the upper surface 906*d* or a location off the upper surface 906*d*). For example, the location may be at one of the two locations that the plurality of first recessed features 908*d*' extend from and/or between. The plurality of first and second recessed features 908*d*', 908*d*" may form a pattern exhibiting a higher concentration of recessed features near the outer edge of the upper surface 906*d* than relative to a concentration of recessed features near center of the upper surface 906*d*. Additionally, the plurality of first and second recessed features 908*d*', 908*d*" form a pattern exhibiting a higher concentration of recessed features near the end locations 909 and 911. As such, the plurality of first and second recessed features 908*d*', 908*d*" may limit spalling to a greater extent near the end locations 909, 911 than near the center of the upper surface 906*d*.

Figure 10A:
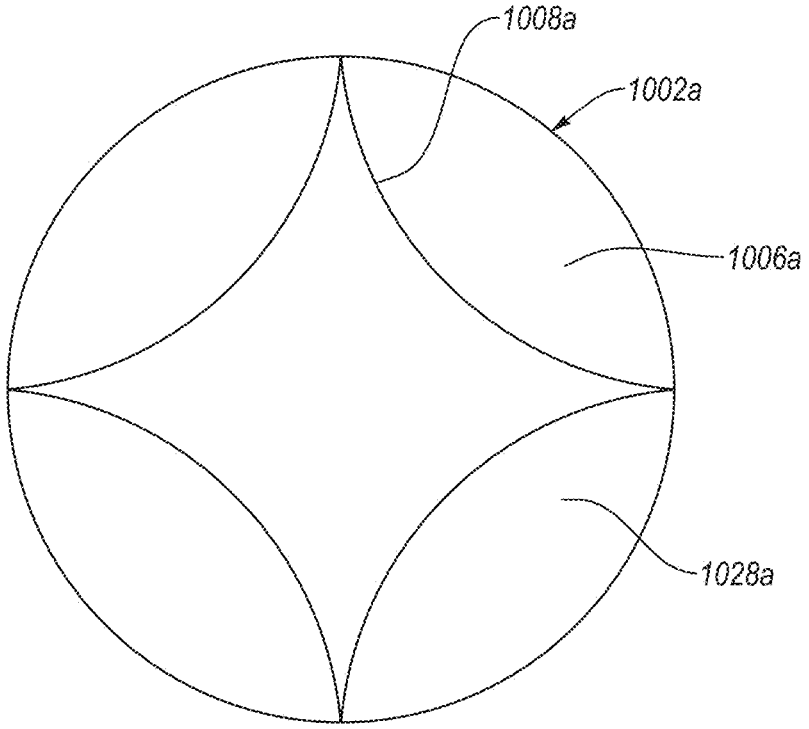

FIGS. 10A-10E illustrate different embodiments where a plurality of recessed features form a generally hypocycloid or hypotrochoid pattern. FIG. 10A illustrates a PCD table 1002*a* that includes a plurality of recessed features 1008*a* formed in an upper surface 1006*a* thereof. The plurality of recessed features 1008*a* may include a plurality of generally arcuately-extending concavely or convexly curved recessed features (e.g., extending between cusps thereof) that, optionally, at least intersect with another recessed feature to form a cusp. In an embodiment, at least some of the plurality of recessed features 1008*a* may exhibit a different distance between the cusps thereof, a different radius of curvature, and/or a different length. In an embodiment, the plurality of recessed features 1008*a* may be substantially the same and form a hypocycloid or a hypotrochoid. For example, in the illustrated embodiment, the plurality of recessed features 1008*a* form a generally hypocycloid shape. However, in other embodiments, the plurality of recessed features 1008*a* form a generally hypotrochoid shape, a generally epicycloid shape, a generally epitrochoid shape, another suitable cycloid, or another suitable trochoid. During operation, the plurality of recessed features 1008*a* may limit spalling in a radial direction and a circumferential direction.

In an embodiment, the plurality of recessed features 1008*a* may form a shape (e.g., cycloid or trochoid) having at least 3 cusps, such as 4, 5, 5-10, 10-15, 15-20, or greater than 20 cusps. The number of cusps of the shape formed from the plurality of recessed features 1008*a* may correspond to the number of cells 1028*a* formed radially outwardly from the shape. In an embodiment, the plurality of recessed features 1008*a* may optionally intersect at the cusps thereof or the plurality of recessed features 1008*a* may optionally intersect at the cusps thereof and at one or more locations between the cusps thereof.

Figure 10B:
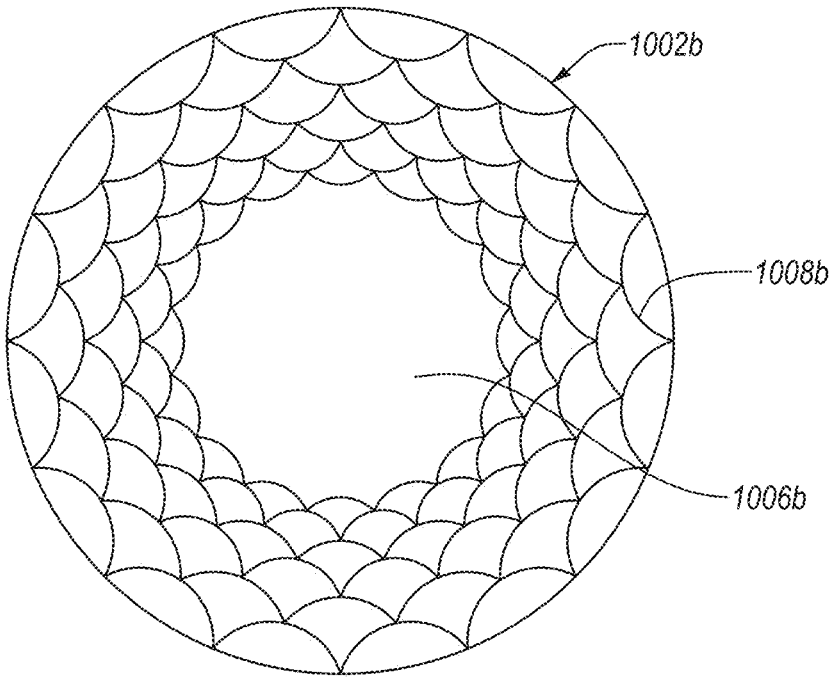
Figure 10C:
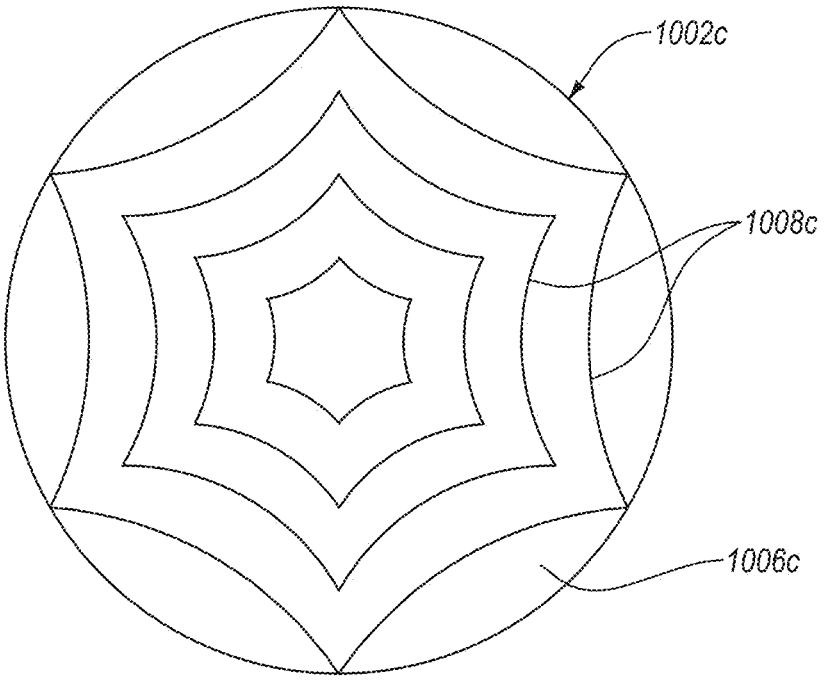

Referring to FIG. 10B, a PCD table 1002*b* includes a plurality of recessed features 1008*b* formed in an upper surface 1006*b* thereof. As shown in FIG. 10B, the plurality of recessed features 1008*b* include a plurality of generally arcuately-extending curved recessed features that intersect at cusps thereof. Similar to the plurality of recessed features 1008*a* (FIG. 10A), at least some of the plurality of recessed features 1008*b* may form one or more hypocycloids, hypotrochoids, or another suitable shape. The cusps of at least some of the plurality of recessed features 1008*b* may contact one or more radially inwardly or outwardly adjacent recessed features 1008*b*. As such, the plurality of recessed features 1008*b* may form a generally scale-like pattern (e.g., a plurality of contiguous hypocycloids). FIG. 10C also illustrates a plurality of recessed features 1008*c* formed in an upper surface 1006*c* of PCD table 1002*c* that include a plurality of generally extending curved recessed features that intersect at cusps thereof. The plurality of recessed features 1008*c* may form a plurality of generally concentric shapes (e.g., cycloids and/or trochoids). However, in some embodiments, the plurality of generally concentric shapes may not contact a radially adjacent recessed feature 1008*c*.

Figure 10D:
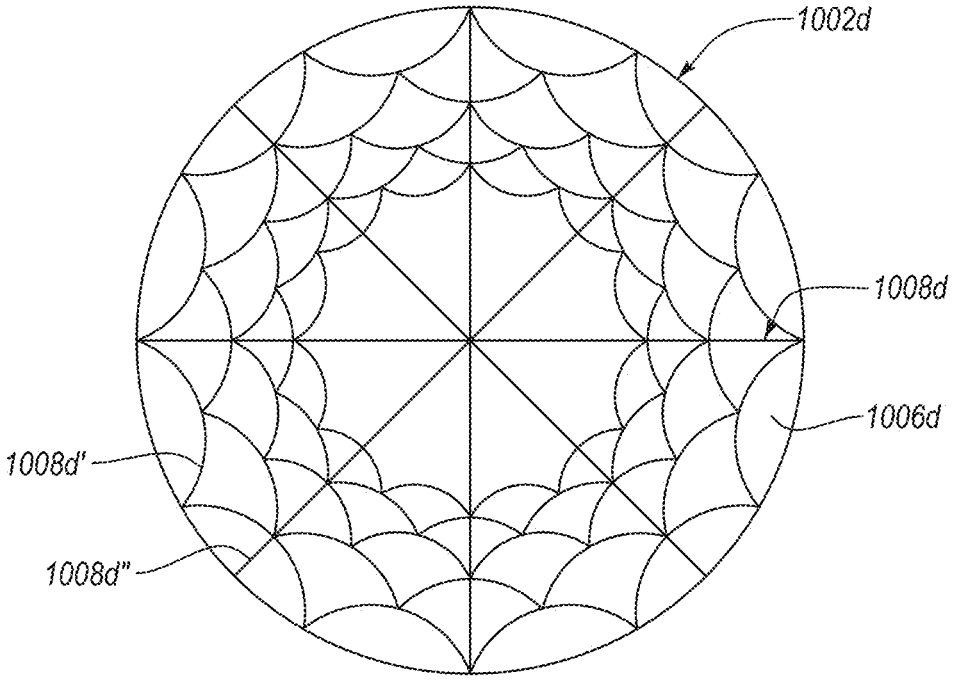

Referring to FIG. 10D, a PCD table 1002*d* includes a plurality of recessed features 1008*d* formed in an upper surface 1006*d* thereof. The plurality of recessed features 1008*d* may form a plurality of first recessed features 1008*d*' and a plurality of second recessed features 1008*d*". The plurality of first recessed features 1008*d*' may be substantially similar to the plurality of recessed features 1008*a* (FIG. 10B). For example, the plurality of first recessed features 1008*d*' may include a plurality recessed features that intersect at the cusps thereof and contact one or more radially adjacent recessed features 1008*d*'. The plurality of second recessed features 1008*d*" may be substantially similar to the plurality of recessed features 608 (FIG. 6). For example, the plurality of second recessed features 1008*d*" may form a generally spoke-like pattern. As such, the plurality of second recessed features 1008*d*" may further limit spalling in a circumferential direction compared to the plurality of recessed features 1008*b* (FIG. 10B).

Figure 10E:
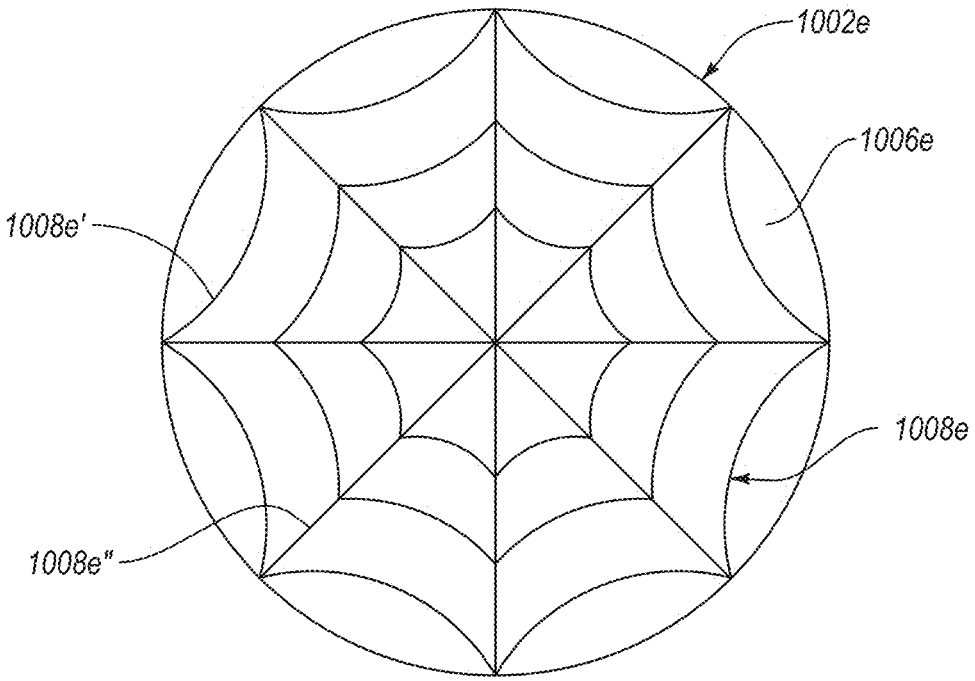

Referring to FIG. 10E, a PCD table 1002*e* includes a plurality of recessed features 1008*e* formed in an upper surface 1006*e* thereof. The plurality of recessed features 1008*e* include a plurality of first recessed features 1008*e*' and a plurality of second recessed features 1008*e*". The plurality of first recessed features 1008*e*' may be substantially similar to the plurality of recessed features 1008*c* (FIG. 10C). For example, the plurality of first recessed features 1008*e*' may include a plurality of generally arcuatedly-extending curved recessed features that intersect at the cusps thereof. The plurality of first recessed features 1008*e*' may form a plurality of generally commonly-centered shapes (e.g., cycloids and/or trochoids). The plurality of second recessed features 1008*e*" may be substantially similar to the plurality of second recessed features 1008*d*" (FIG. 10D). As such, the plurality of recessed features 1008*e* may form a generally web-like pattern. The plurality of first recessed features 1008*e*' may limit spalling generally in a radial direction and the plurality of second recessed features 1008*e*" may limit spalling generally in a circumferential direction.

In an embodiment, the plurality of first recessed features 1008*e*' may not form a plurality of generally concentric shapes. Instead, the plurality of first recessed features 1008*e*' may include a plurality of curved recessed features that extend between the plurality of second recessed features 1008*e*". For example, at least some of the plurality of first recessed features 1008*e*' may not intersect at the cusp thereof and may be radially spaced relative to a circumferentially adjacent first recessed feature 1008*e'*.

The following working examples of the present disclosure set forth various configurations that have been used to form the PDC cutting elements disclosed herein. The following working examples provide further detail in connection with the embodiments described above.

Comparative Example 1

A conventional PDC was formed from a bimodal mixture of diamond particles having respective modes at about 30 μm and about 2 μm. The mixture of diamond particles was positioned adjacent to a cobalt-cemented tungsten carbide substrate. The plurality of diamond particles were sintered and bonded to the substrate in an HPHT process having a cell pressure of about 7.8 GPa and a temperature of about 1360° C. to form the conventional PDC including a PCD table. The PDC table was then partially leached to form a leached region having a first leach depth from an upper surface of the PCD table of about 490 μm, a side leach depth of about 80 μm, and a $L_1$* value of about 200 μm. The conventional PDC did not have any recessed features formed in an upper surface thereof.

The conventional PDC was then subjected to a milling spallation test in which the PDC was used to cut a Barre granite workpiece. The test parameters used for the milling test were a back rake angle for the PDC of about 20°, an in-feed for the PDC of about 50.8 cm/min, a rotary speed on the workpiece of about 3000 RPM, an indexing across the workpiece (e.g., in the Y direction) of about 7.62 cm, about 3-5 seconds (no more than 10 seconds) between cutting passes, and the size of the Barre granite workpiece was about 63.5 cm by about 48.3 cm. The PDCs were held in a cutting tool holder, with the substrate of the PDCs tested thermally insulated on its back side via an alumina disc and along its circumference by a plurality of zirconia pins. The conventional PDC was subject to the milling test until the conventional PDC spalled. Spalling of the PDC was determined using a "burnout" method in which spalling was detected when at least one of the operator detected sparks, the operator noticed black marks on the Barre granite, a sharp rise in the detected temperature, or a slight change in the force measurements.

Figure 11:
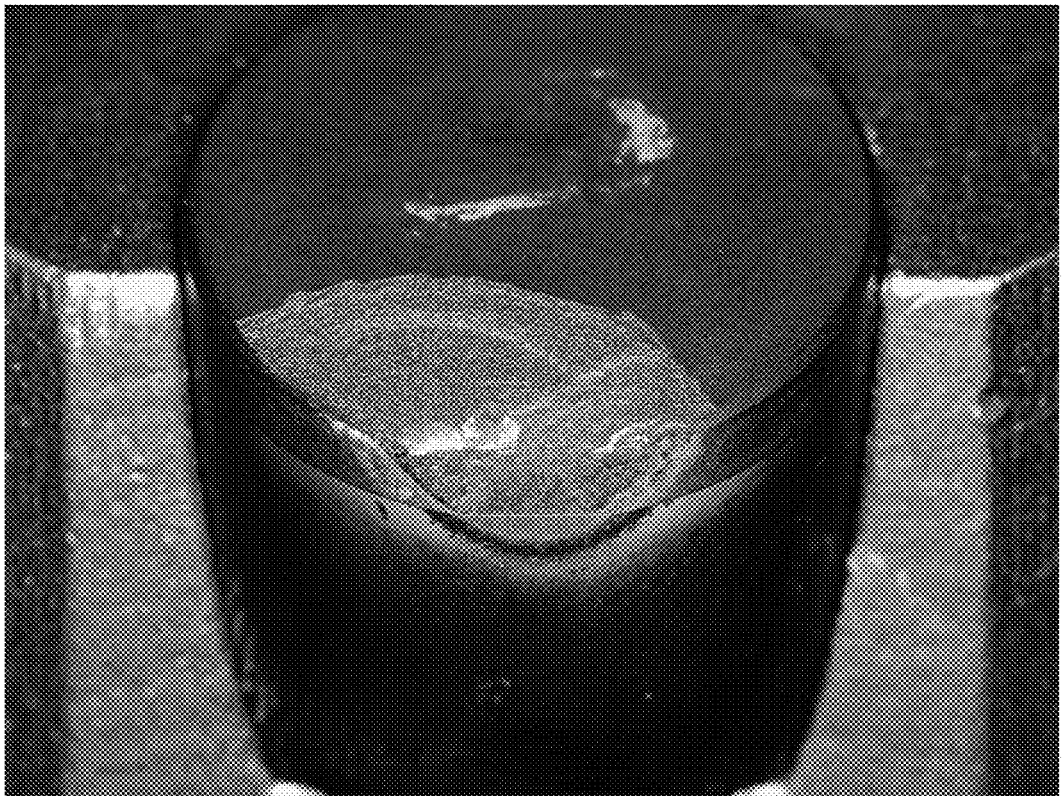
FIG. 11 is a photograph of a conventional PDC after the conventional PDC spalled.

FIG. 11 is a photograph of the conventional PDC after the conventional PDC spalled. FIG. 11 illustrates that the spalled conventional PDC includes a spalled region that extended significantly into the PCD table in both a radial direction and a circumferential direction. Additionally, the PCD table included a plurality of cracks (e.g., microcracks) that extended from the spalled region into the PCD table.

Example 2

A PDC was formed as described in comparative example 1 prior to leaching. The PDC table of example 2 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 2 using a laser. The plurality of recessed features included a plurality of circumferentially-extending first recessed features and a plurality of radially-extending second recessed features that were substantially similar to the plurality of first recessed features 1008*e*' and the plurality of second recessed features 1008*e*" (FIG. 10E), respectively. The PDC of example 2 was then tested in a milling spallation test using the same test parameters as comparative example 1. The PDC of example 2 was tested until the PDC of example 2 spalled.

Figure 12A:
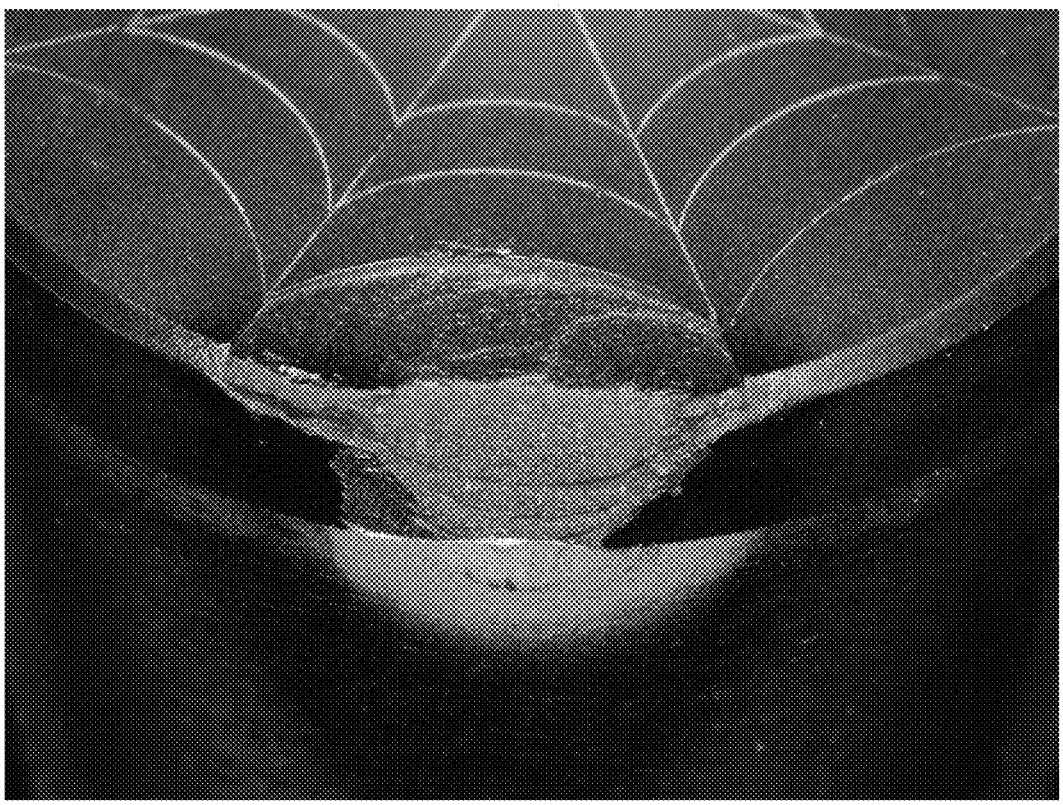
FIGS. 12A-12G are photographs of different working examples of PDCs according to embodiments of the present disclosure, which include a plurality of recessed features formed thereon, after the different PDCs have spalled.

FIG. 12A is a photograph of the PDC of example 2 after the PDC of example 2 spalled. FIG. 12A illustrates that the spalled PDC of example 2 included a spalled region that was radially and circumferentially limited by the plurality of first and second recessed features, respectively. As such, the spalled region is partially defined by the plurality of first and second recessed features. Additionally, the inventors believe that the plurality of recessed features limited cracks extending from the spalled region into the PCD table of example 2. As such, the plurality of recessed features may increase the usability of the PDC of example 2. For example, the PDC of example 2 can be subjected to another milling test by rotating the PDC of example 2 such that a portion of the PCD table of example 2 that does not include the spalled region forms the cutting contact area.

Example 3

A PDC was formed as described in comparative example 1 prior to leaching. The PDC table of example 3 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 3 using a laser. The plurality of recessed features included a plurality of arcuately-extending first recessed features and a plurality of generally radially-extending second recessed features (e.g., substantially similar to the plurality of first recessed features 1008*e*' and the plurality of second recessed features 1008*e*" (FIG. 10E), respectively). The PDC of example 3 was then tested in milling spallation test using the same test parameters as comparative example 1. The PDC of example 3 was tested until the PDC of example 3 spalled.

Figure 12B:
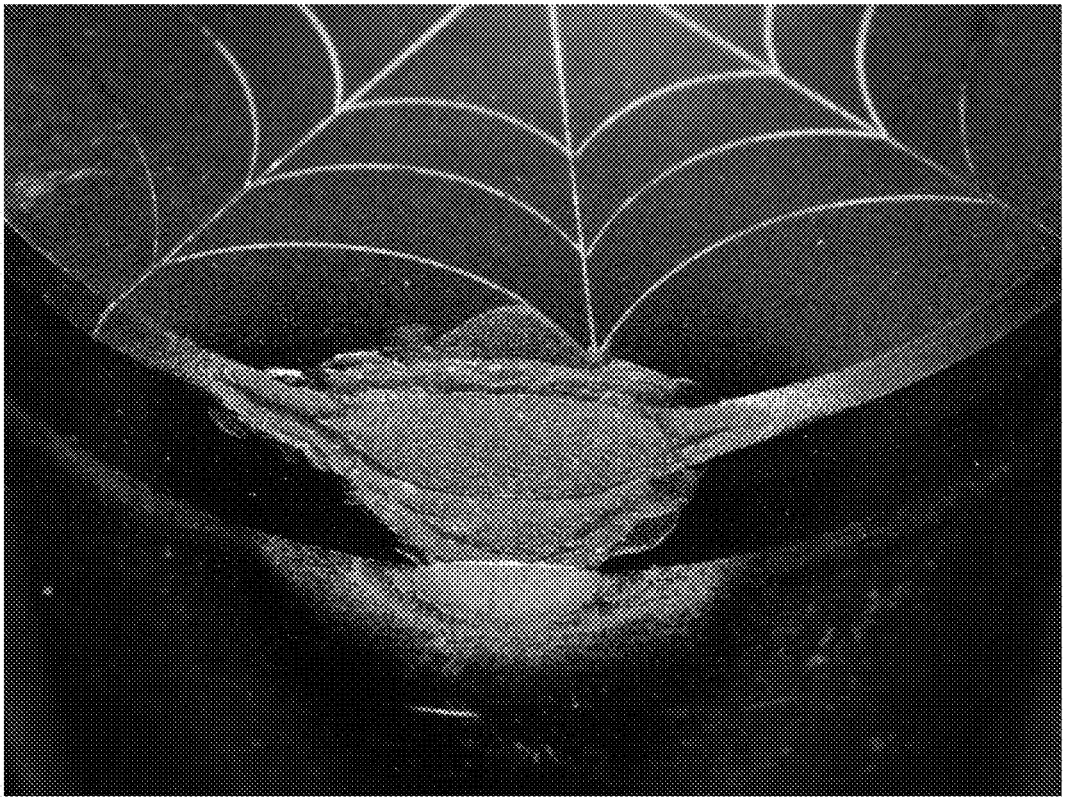

FIG. 12B is a photograph of the PDC of example 3 after the PDC of example 3 spalled. FIG. 12B illustrates that the spalled PDC of example 3 included a spalled region that was radially limited by the plurality of first recessed features. As such, the spalled region is partially defined by the plurality of first recessed features. Additionally, the inventors believe that the plurality of recessed features limited cracks extending from the spalled region into the PCD table of example 3. As such, the plurality of recessed features may increase the usability of the PDC of example 3. For example, the PDC of example 3 can be subjected to another milling test by rotating the PDC of example 3 such that a portion of the PCD table of example 3 that does not include the spalled region forms the cutting contact area.

Example 4

A PDC was formed as described in comparative example 1 prior to leaching. The PDC table of example 4 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 4 using a laser. The plurality of recessed features included a plurality of arcuately-extending first recessed features and a plurality of generally radially-extending second recessed features (e.g., substantially similar to the plurality of first recessed features 1008*e*' and the plurality of second recessed features 1008*e*" (FIG. 10E), respectively). The PDC of example 4 was then tested in milling spallation test using the same test parameters as comparative example 1. The PDC of example 4 was tested until the PDC of example 4 spalled.

Figure 12C:
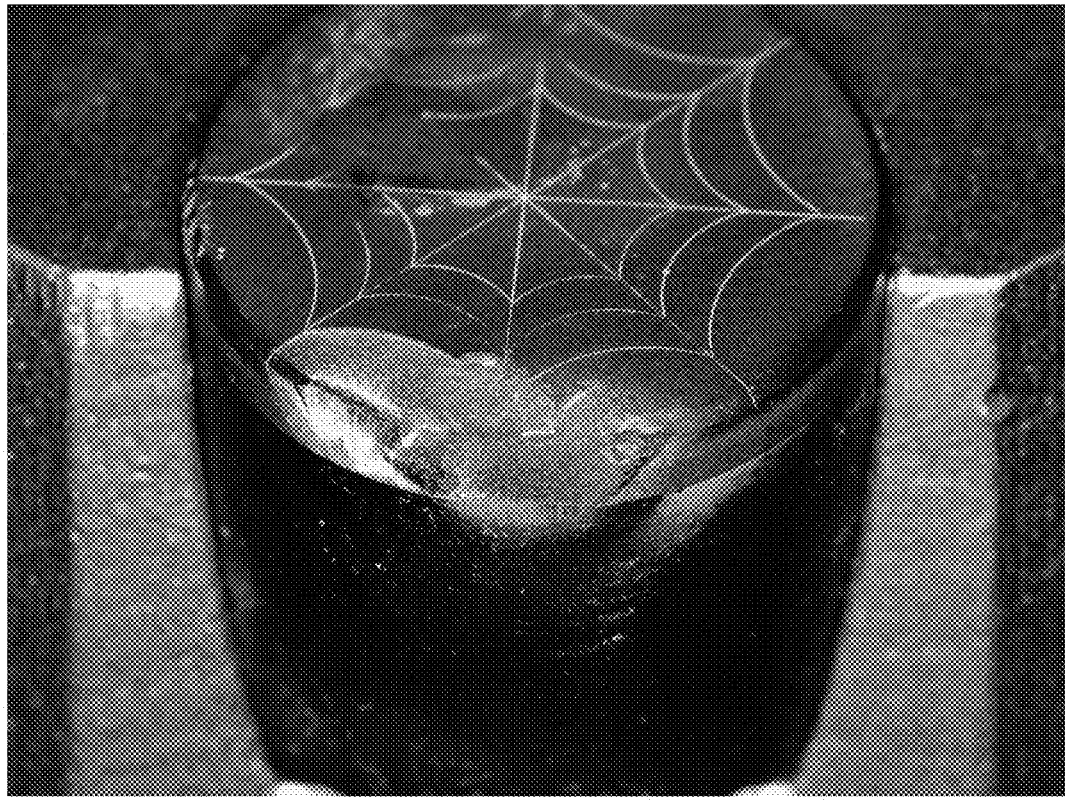

FIG. 12C is a photograph of the PDC of example 4 after the PDC of example 4 spalled. FIG. 12C illustrates that the spalled PDC of example 4 included a spalled region that was radially and circumferentially limited by the plurality of first and second recessed features, respectively. As such, the spalled region is partially defined by the plurality of first and second recessed features. Additionally, it is believed by the inventors that the plurality of recessed features limited cracks extending from the spalled region into the PCD table of example 4. As such, the plurality of recessed features may increase the usability of the PDC of example 4. For example, the PDC of example 4 can be subjected to another milling test by rotating the PDC of example 4 such that a portion of the PCD table of example 4 that does not include the spalled region forms the cutting contact surface.

Example 5

A PDC was formed as described in comparative example 1 prior to leaching. The PDC table of example 5 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 5 using a laser. The plurality of recessed features included a plurality of arcuately-extending first recessed features and a plurality of generally radially-extending second recessed features (e.g., substantially similar to the plurality of first recessed features 908*b*' and the plurality of second recessed features 908*b*" (FIG. 9B), respectively). The PDC of example 5 was then tested in milling spallation test using the same test parameters as comparative example 1. The PDC of example 5 was tested in a milling test until the PDC of example 5 spalled.

Figure 12D:
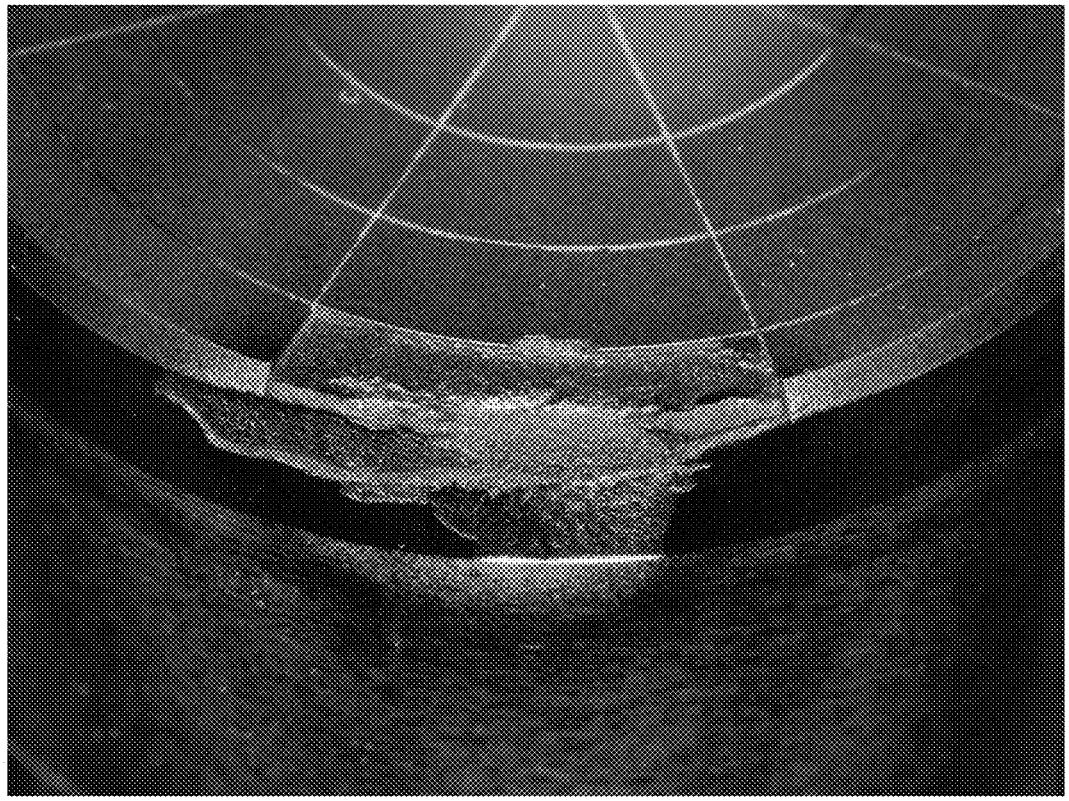

FIG. 12D is a photograph of the PDC of example 5 after the PDC of example 5 spalled. FIG. 12D illustrates that the spalled PDC of example 5 included a spalled region that was radially and circumferentially limited by the plurality of first and second recessed features. As such, the spalled region is partially defined by the plurality of first and second recessed features. Additionally, the inventors believe that the plurality of recessed features limited cracks extending from the spalled region into the PCD table of example 5. As such, the plurality of recessed features may increase the usability of the PDC of example 5. For example, the PDC of example 5 can be subjected to another milling test by rotating the PDC of example 5 such that a portion of the PCD table of example 5 that does not include the spalled region forms the cutting contact surface.

Example 6

A PDC was formed as described in comparative example 1 prior to leaching. The PDC table of example 6 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 6 using a laser. The plurality of recessed features included a plurality of arcuately-extending first recessed features and a plurality of generally radially-extending second recessed features (e.g., substantially similar to the plurality of first recessed features 908*b*' and the plurality of second recessed features 908*b*" (FIG. 9B), respectively). The PDC of example 6 was then tested in milling spallation test using the same test parameters as comparative example 1. The PDC of example 6 was tested until the PDC of example 6 spalled.

Figure 12E:
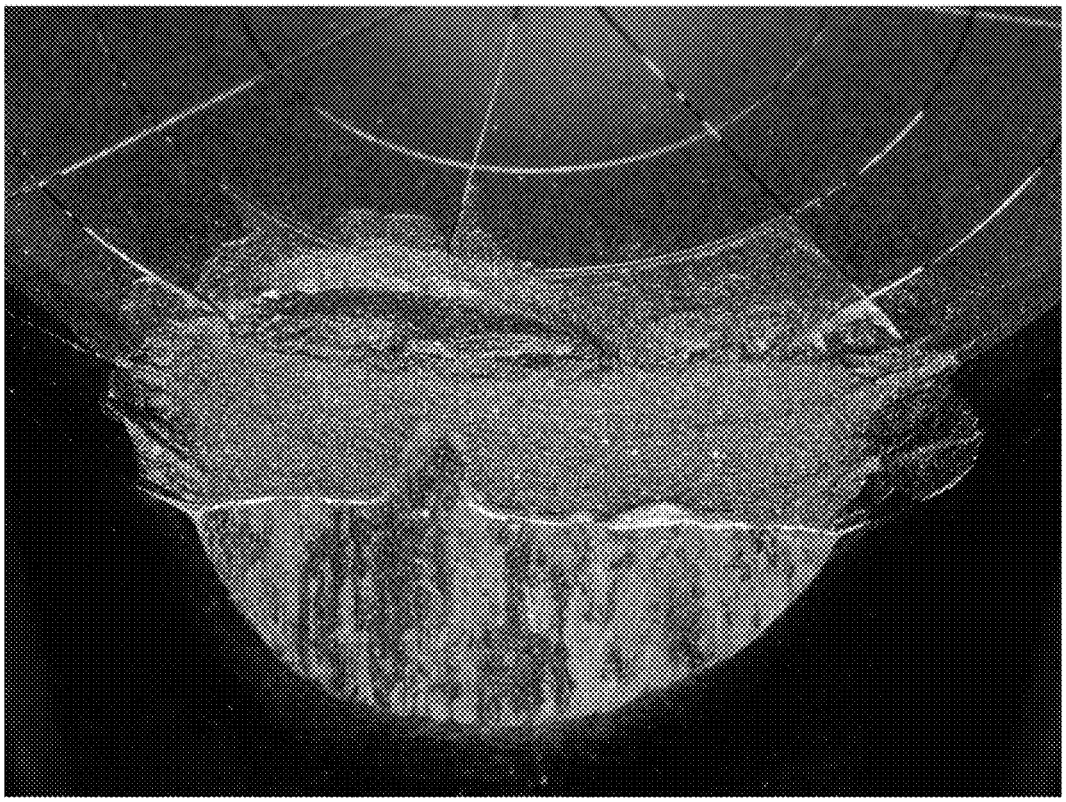

FIG. 12E is a photograph of the PDC of example 6 after the PDC of example 6 spalled. FIG. 12E illustrates that the spalled PDC of example 6 includes a spalled region that was radially and circumferentially limited by the plurality of first and second recessed features, respectively. As such, the spalled region is partially defined by the plurality of first and second recessed features. FIG. 12E also illustrates how generally commonly centered shapes may limit spallation. Additionally, it is believed by the inventors that the plurality of recessed features limited cracks extending from the spalled region into the PCD table of example 6. As such, the plurality of recessed features may increase the usability of the PDC of example 6. For example, the PDC of example 6 can be subjected to another milling test by rotating the PDC of example 6 such that a portion of the PCD table of example 6 that does not include the spalled region forms the cutting contact surface.

Example 7

A PDC was formed as described in comparative example 1 prior to leaching. The PDC table of example 7 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 7 using a laser. The plurality of recessed features formed a generally rectangular grid-like pattern (FIG. 7A). The PDC of example 7 was then tested in milling spallation test using the same test parameters as comparative example 1. The PDC of example 7 was tested until the PDC of example 7 spalled.

Figure 12F:
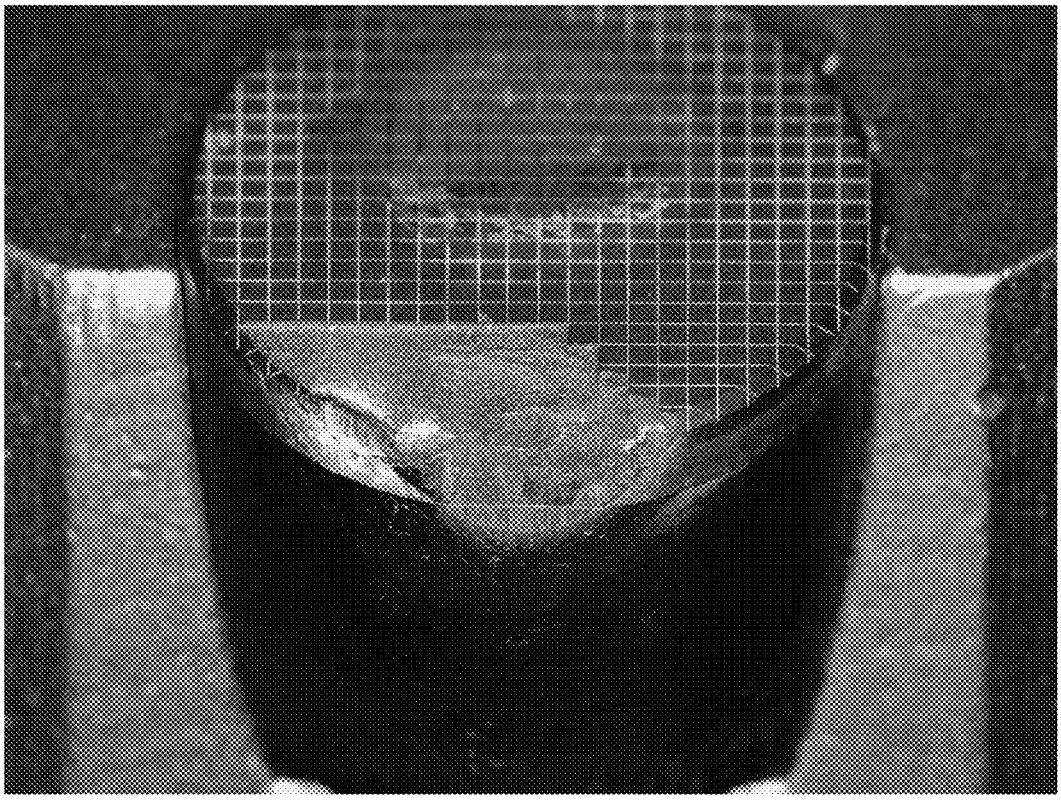

FIG. 12F is a photograph of the PDC of example 7 after the PDC of example 7 spalled. FIG. 12F illustrates that the spalled PDC of example 7 included a spalled region that was radially and circumferentially limited by the plurality of recessed features. As such, the spalled region is partially defined by the plurality of recessed features. Additionally, it is believed by the inventors that the plurality of recessed features limited cracks extending from the spalled region into the PCD table of example 7. As such, the plurality of recessed features may increase the usability of the PDC of example 7. For example, the PDC of example 7 can be subjected to another milling test by rotating the PDC of example 7 such that a portion of the PCD table of example 7 that does not include the spalled region forms the cutting contact surface.

Example 8

A PDC was formed as described in comparative example 1 prior to leaching. The PDC table of example 8 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 8 using a laser. The plurality of recessed features form a plurality of generally commonly centered hypocycloids (e.g., similar to the plurality of recessed features 1008*b* (FIG. 10B)). The PDC of example 8 was then tested in milling spallation test using the same test parameters as comparative example 1. The PDC of example 8 was tested until the PDC of example 8 spalled.

Figure 12G:
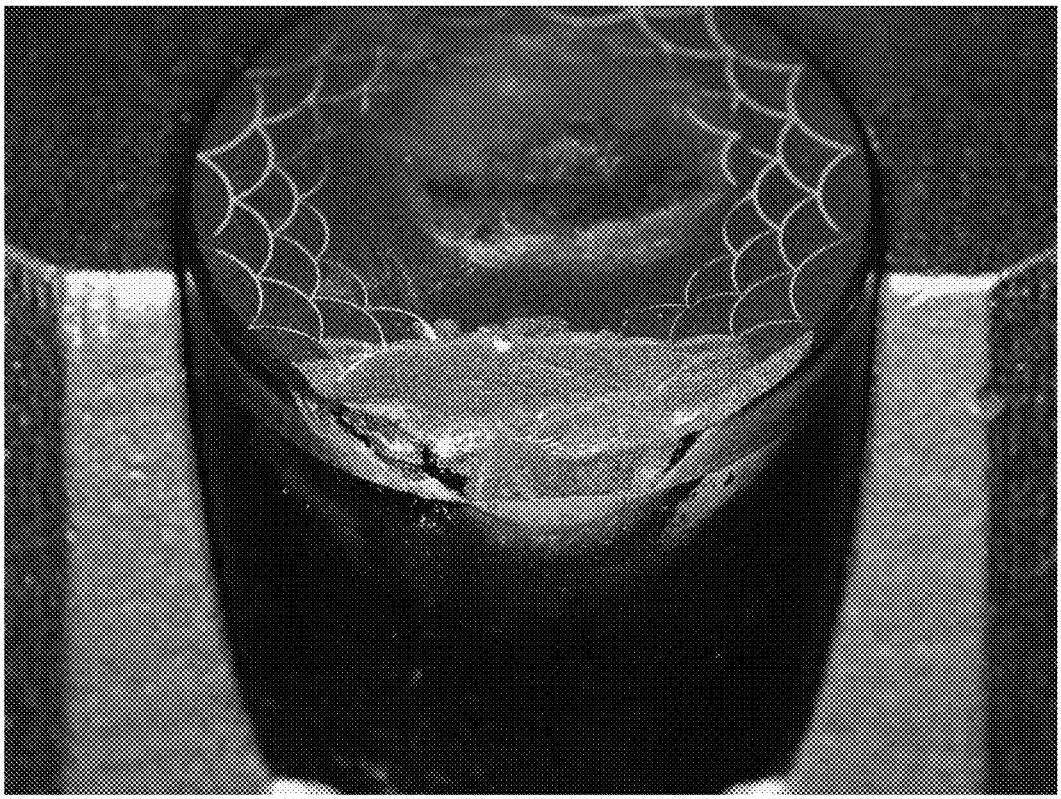

FIG. 12G is a photograph of the PDC of example 8 after the PDC of example 8 spalled. FIG. 12G illustrates that the spalled PDC of example 8 included a spalled region that was radially and circumferentially limited by the plurality of first and second recessed features, respectively. As such, the spalled region is partially defined by the plurality of first and second recessed features. The area of the spalled region measured about 19 $mm^2$, which is about 9.4% of the area of the upper surface of the PDC of example 8. FIG. 12G also illustrates how generally concentric shapes may act as fail-safes to an outermost shape. Additionally, it is believed that the plurality of recessed features limited cracks extending from the spalled region into the PCD table of example 8. As such, the plurality of recessed features may increase the usability of the PDC of example 8. For example, the PDC of example 8 can be subjected to another milling test by rotating the PDC of example 8 such that a portion of the PCD table of example 8 that does not include the spalled region forms the cutting contact surface.

Example 9

A PDC was formed as described in comparative example 1 prior to leaching. The PDC table of example 9 was then partially leached to form a leached region having a first leach depth from an upper surface of the PCD table of about 490 μm, a side leach depth of about 80 μm, and a $L_1$* value of about 200 μm. A plurality of recessed features having an average depth of about 75 μm was then formed in the upper surface of the PCD table of example 9 using a laser. The plurality of recessed features included a plurality of spirally-extending first recessed features and a plurality of second recessed features extending between the plurality of first recessed features (e.g., similarly to the plurality of first recessed features 808*b*' and the plurality of second recessed features 808*b*" (FIG. 8B), respectively). The PDC of example 9 was then tested in milling spallation test using the same test parameters as comparative example 1. The PDC of example 9 was tested until the PDC of example 9 spalled.

The PDC of example 9 included a spalled region that was radially and circumferentially limited by the plurality of first and second recessed features, respectively. As such, the spalled region is partially defined by the plurality of first and second recessed features. Additionally, it is believed that the plurality of recessed features limited cracks extending from the spalled region into the PCD table of example 9. As such, the plurality of recessed features may increase the usability of the PDC of example 9. For example, the PDC of example 9 can be subjected to another milling test by rotating the PDC of example 9 such that a portion of the PCD table of example 9 that does not include the spalled region forms the cutting contact surface.

Probability of Failure of Comparative Example 1 and Working Examples 2, 7, 8 and 9

The thermal stability for several of the PDCs disclosed herein were measured by determining a distance that the PDCs cut in a mill test prior to failure. Four PDCs were formed according to the methods disclosed in each of comparative example 1 and working examples 2, 7, 8, and 9. Each of the PDCs were then subjected to a milling test in which the PDCs are used to cut the same Barre granite workpiece without any coolant (e.g., dry cutting of the Barre granite workpiece in air). The test parameters used for the milling test were the same as described above in comparative example 1. Failure is determined when the PDCs can no longer cut the workpiece (e.g., spall). Spalling of the PDC was determined using a "burnout" method where spalling was detected when at least one of the operator detected sparks, the operator noticed black marks on the Barre granite, a sharp rise in the detected temperature, or a slight change in the force measurements. The distance each PDC cut prior to failure was calculated by: (the width of the workpiece)×(the number of complete passes)+(the distance cut on the last pass prior to failure).

Figure 13:
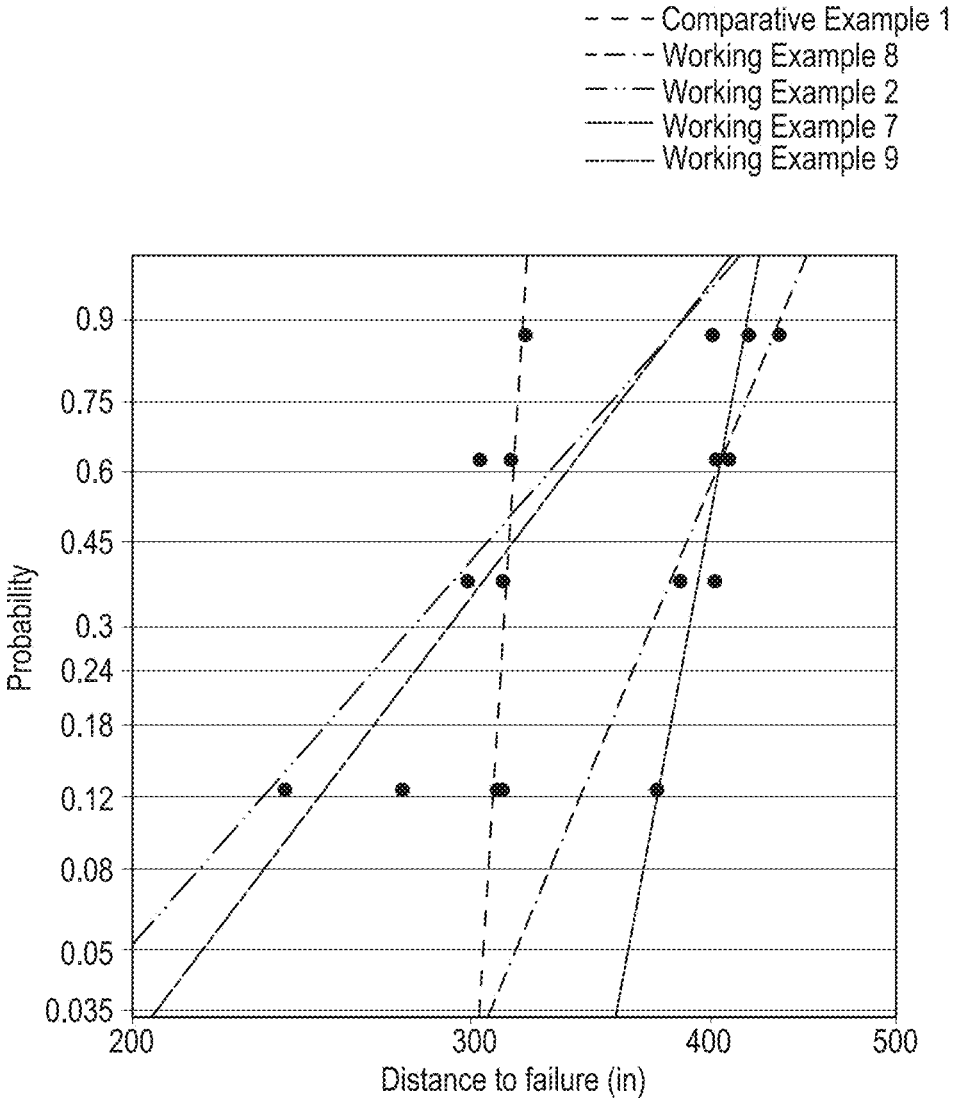
FIG. 13 is a graph showing probability of failure of comparative example 1 and working examples 2, 7, 8, and 9 versus distance each PDC cut prior to failure.

FIG. 13 is a graph showing probability of failure of comparative example 1 and working examples 2, 7, 8, and 9 versus distance each PDC cut prior to failure. FIG. 13 illustrates that a probability of failure at relatively large distances cut for working examples 2, 7, 8, and 9 was superior to comparative example 1. For example, the graph illustrates that the comparative example 1 exhibited a probability of failure of about 0.1 at a distance cut of about 305 inches, a probability of failure of about 0.4 at a distance cut of about 310 inches, and a probability of failure of about 0.75 at a distance cut of about 315 inches. In contrast, the graph illustrates that at least some of the working examples exhibit a probability of failure less than about 0.1 at a distance cut of about 315 inches or greater (e.g., about 315 inches to about 325 inches, about 325 inches to about 350, about 350 inches or greater), a probability of failure less than about 0.4 at a distance cut of about 325 inches or greater (e.g., about 325 inches to about 350 inches, about 350 inches to about 375 inches, about 375 inches to about 400 inches, greater than 400 inches), a probability of failure less than about 0.75 at a distance cut of about 340 inches or greater (e.g., about 350 inches to about 375 inches, about 375 inches to about 400 inches, about 400 inches to about 425 inches, about 425 inches or greater).

The disclosed PDC embodiments may be used in a number of different applications including, but not limited to, use in a rotary drill bit (FIGS. 14A and 14B), a thrust-bearing apparatus, a radial bearing apparatus, a mining rotary drill bit (e.g., a roof bolt drill bit), and a wire-drawing die. The various applications discussed above are merely some examples of applications in which the PDC embodiments may be used. Other applications are contemplated, such as employing the disclosed PDC embodiments in friction stir welding tools.

Figure 14A:
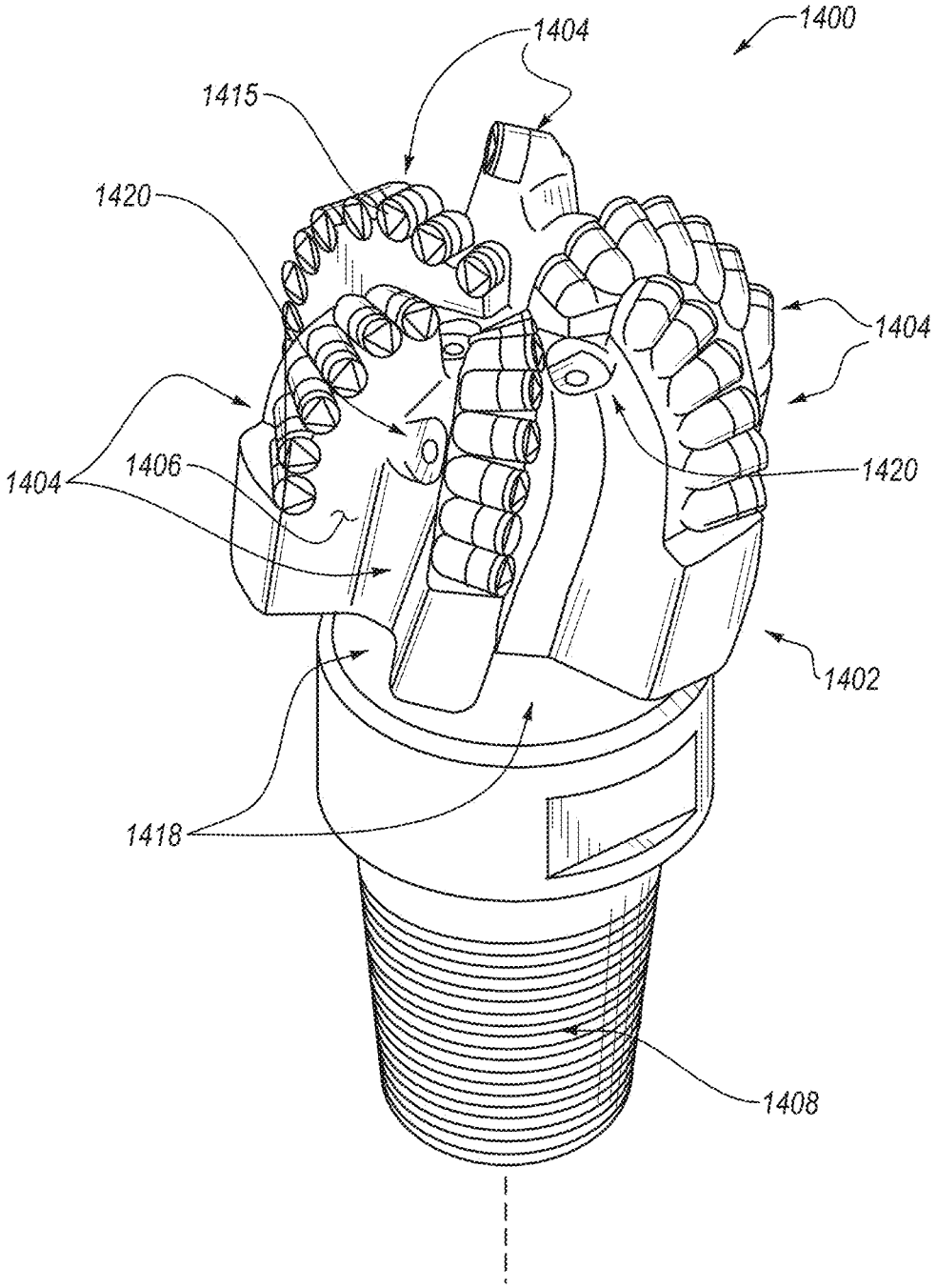
FIG. 14A is an isometric view of an embodiment of a rotary drill bit that may employ one or more of the disclosed PDC embodiments.
Figure 14B:
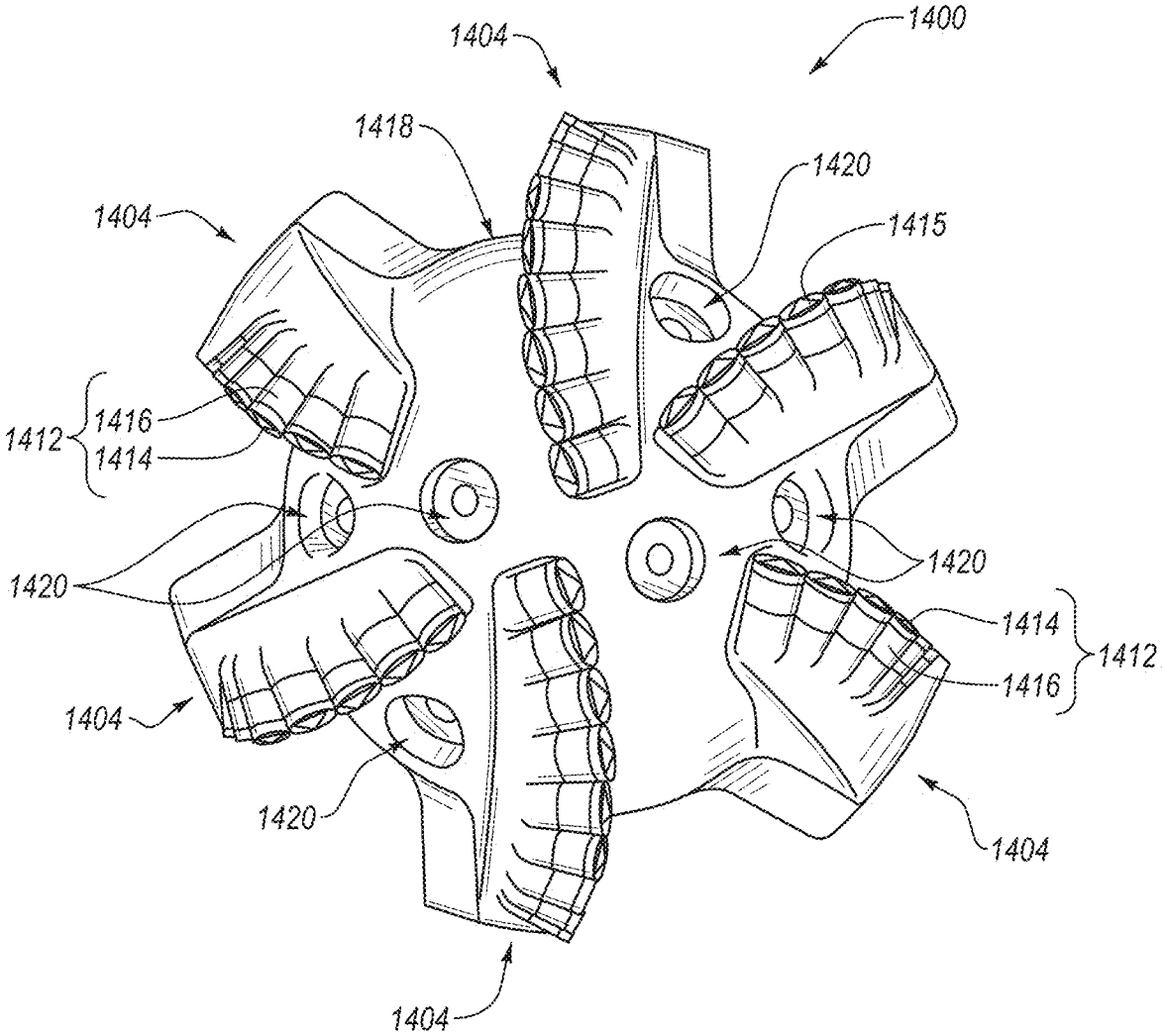
FIG. 14B is a top plan view of the rotary drill bit shown in FIG. 14A.

FIG. 14A is an isometric view and FIG. 14B is a top plan view of an embodiment of a rotary drill bit 1400 for use in subterranean drilling applications, such as oil and gas exploration. The rotary drill bit 1400 includes at least one PCD element and/or PDC configured according to any of the previously described PDC embodiments. The rotary drill bit 1400 comprises a bit body 1402 that includes radially and longitudinally extending blades 1404 with leading faces 1406, and a threaded pin connection 1408 for connecting the bit body 1402 to a drilling string. The bit body 1402 defines a leading end structure for drilling into a subterranean formation by rotation about a longitudinal axis and application of weight-on-bit. At least one PDC cutting element, configured according to any of the previously described PDC embodiments may be affixed to the bit body 1402.

With reference to FIG. 14B, a plurality of PDCs 1412 are secured to the blades 1404. For example, each PDC 1412 may include a PCD table 1414 bonded to a substrate 1416. More generally, the PDCs 1412 may comprise any PDC disclosed herein, without limitation. For example, the PCD table 1414 may include the plurality of recessed features 1415 formed in an upper surface thereof. In addition, if desired, in some embodiments, a number of the PDCs 1412 may be conventional in construction. Also, circumferentially adjacent blades 1404 define so-called junk slots 1418 therebetween, as known in the art. Additionally, the rotary drill bit 1400 may include a plurality of nozzle cavities 1420 for communicating drilling fluid from the interior of the rotary drill bit 1400 to the PDCs 1412.

In an embodiment, the plurality of PDCs 1412 may be secured to the blades 1404 using a brazing technique, a mechanical fastener, a high temperature adhesive, press-fitting, or another suitable technique. The rotary drill bit 1400 may then be used in one or more subterranean drilling operations until at least one of the plurality of PDCs 1412 spall ("spalled PDC"). Spalling of the PDCs 1412 may be detected by sudden changes in force exerted by the plurality of PDCs 1412 against a subterranean surface, visual inspection, audible cues, or combinations thereof, etc. After one or more PDCS 1412 spall, the spalled PDC 1412 may be removed from the rotary drill bit 1400. For example, if the spalled PDC 1412 is brazed to the rotary drill bit 1400, the spalled PDC 1412 may be heated sufficiently to melt at least some of the braze material. The spalled PDC 1412 may then be rotated relative to the rotary drill bit 1400 to position a portion of the spalled PDC 1412 that does not include a spalled region in a cutting position. The spalled PDC 1412 may then be secured to the rotary drill bit 1400 using any of the techniques previously disclosed. The rotary drill bit 1400 may then be used in subterranean drilling operations.

FIGS. 14A and 14B merely depict one embodiment of a rotary drill bit that employs at least one PDC fabricated and structured in accordance with the disclosed embodiments, without limitation. The rotary drill bit 1400 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,274,900; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference. Examples of other articles of manufactures that the PDCs disclosed herein can be used in are disclosed in U.S. Provisional Patent Application No. 62/232,732; U.S. patent application Ser. Nos. 13/790,046, 14/273,360, 14/275,574, and 14/811,699.

While various aspects and embodiments have been disclosed herein, other aspects and embodiments are contemplated. The various aspects and embodiment disclosed herein are for purposes of illustration and are not intended to be limiting. Additionally, the words "including," having," and variants thereof (e.g., "includes" and "has") as used herein, including the claims, shall be open ended and have the same meaning as the word "comprising" and variants thereof (e.g., "comprise" and "comprises").

What is claimed is:

1. A method of fabricating a polycrystalline diamond compact, the method comprising:

leaching at least a portion of at least one interstitial constituent from a polycrystalline diamond table to a leach depth measured inwardly from an upper surface and to a lateral leach depth measured inwardly from at least one lateral surface of the polycrystalline diamond table to form a leached region, the leach depth being less than a depth of the polycrystalline diamond table to produce an unleached region;

after leaching the polycrystalline diamond table, forming a plurality of recessed features that extend from the upper surface of the polycrystalline diamond table to a depth less than the leach depth of the leached region such that the plurality of recessed features are entirely contained within the leached region and do not extend into the unleached region of the polycrystalline diamond table; and forming at least a portion of one recessed feature of the plurality of recessed features proximate to an anticipated leach boundary-wear intersection location;

wherein forming the plurality of recessed features forms a plurality of cells on the upper surface that are at least partially defined by the plurality of recessed features.

2. The method of claim 1, wherein forming a plurality of recessed features includes forming the plurality of recessed features using at least one of a laser, electrical discharge machining, a water jet, or grinding.

3. The method of claim 1, wherein the leached region exhibits a first leach depth measured from the upper surface and a second leach depth measured from a base of each of the plurality of recessed features that is less than the first leach depth.

4. The method of claim 3, wherein leaching at least a portion of at least one interstitial constituent from a polycrystalline diamond table includes leaching the polycrystalline diamond table until the first leach depth is about 200 μm to about 900 μm.

5. The method of claim 3, wherein forming a plurality of recessed features includes forming the plurality of recessed features to exhibit the second leach depth that is about 1% to about 75% less than the first leach depth.

6. The method of claim 1, wherein forming a plurality of recessed features includes forming the plurality of recessed features using acid etching or plasma etching.

7. The method of claim 1, wherein forming a plurality of recessed features includes forming at least one of the plurality of the plurality of recessed features to exhibit a depth measured from the upper surface to a base thereof that is different from at least one other of the plurality of recessed features.

8. The method of claim 1, wherein forming a plurality of recessed features includes forming at least one of the plurality of recessed features to exhibit a depth measured from the upper surface to a base thereof that is about 50 μm to about 500 μm.

9. The method of claim 1, wherein one or more of the plurality of recessed features exhibit an average maximum width and an average maximum depth, the average maximum depth is greater than or equal to the average maximum width.

10. The method of claim 9, wherein forming a plurality of recessed features includes forming the one or more of the plurality of recessed features to exhibit a ratio of the average maximum depth to the average maximum width of about 1.5 to about 3.

11. The method of claim 1, wherein forming a plurality of recessed features includes forming at least a plurality of substantially parallel recesses that are spaced from each other by a distance that is less than 650 μm.

12. The method of claim 1, wherein forming a plurality of recessed features includes forming at least some of the plurality of recessed features in at least one of a hypocycloid or hypotrochoid shape.

13. The method of claim 1, wherein forming the plurality of recessed features includes forming at least some of the plurality of recessed features in a triangular grid-like pattern, a rectangular grid-like pattern, or a hexagonal grid-like pattern.

14. The method of claim 1, wherein forming a plurality of recessed features includes forming the plurality of recessed features to exhibit, in side view, at least one of a generally arcuate cross-section, a generally triangular cross-section, or a generally rectangular cross-section.

15. The method of claim 1, wherein forming a plurality of recessed features includes forming a plurality of cells at least partially defined by at least one of the plurality of recessed features, an average a surface area of each of the plurality of cells is 5% of a total surface area of the upper surface or less.

16. A method of fabricating a polycrystalline diamond compact, the method comprising:

leaching at least a portion of at least one interstitial constituent from a polycrystalline diamond table to a leach depth measured inwardly from an upper surface and to a lateral leach depth measured inwardly from at least one lateral surface of the polycrystalline diamond table to form a leached region, the leach depth being less than a depth of the polycrystalline diamond table to produce an unleached region;

after leaching the polycrystalline diamond table, forming a plurality of recessed features that extend from the upper surface of the polycrystalline diamond table to a depth less than the leach depth of the leached region using at least one of etching, a laser machining, electrical discharge machining, a water jet machining, or grinding, one or more of the plurality of recessed features exhibiting an average maximum width and an average maximum depth, the average maximum depth is greater than or equal to the average maximum width, wherein the plurality of recessed features exhibit, in side view, at least one of a generally arcuate cross-section, a generally triangular cross-section, or a generally rectangular cross-section; and forming at least a portion of one recessed feature of the plurality of recessed features proximate to an expected wear front that intersects with an interface between the unleached region and the leached region;

wherein forming the plurality of recessed features forms a plurality of cells on the upper surface that are at least partially defined by the plurality of recessed features; and wherein the leached region exhibits a first leach depth measured from the upper surface and a second leach depth measure from a base of each of the plurality of recessed features that is about 1% to about 75% less than the first leach depth.

17. A method of fabricating a polycrystalline diamond compact, the method comprising:

leaching at least a portion of at least one interstitial constituent from a polycrystalline diamond table to a leach depth measured inwardly from an upper surface to form a leached region;

maintaining an unleached region in the polycrystalline diamond table;

after leaching the polycrystalline diamond table, forming a plurality of recessed features that extend from the upper surface of the polycrystalline diamond table to a depth less than the leach depth of the leached region;

forming at least a portion of one recessed feature of the plurality of recessed features proximate to an expected wear front and proximate to an interface between the unleached region and the leached region; and at least partially defining a plurality of cells on the upper surface with the plurality of recessed features.

18. The method of claim 17, further comprising locating the plurality of recessed features entirely within the leached region.

19. The method of claim 17, further comprising restricting the depth the plurality of recessed features to a location spaced from the unleached region.

20. The method of claim 17, further comprising extending the depth the plurality of recessed features to a location short of the interface between the unleached region and the leached region in the polycrystalline diamond table.

* * * * *